US008449087B2

(12) United States Patent
Kataoka et al.

(10) Patent No.: US 8,449,087 B2
(45) Date of Patent: May 28, 2013

(54) LIQUID CIRCULATING APPARATUS, COMPUTER-READABLE MEDIUM, AND LIQUID DISCHARGING APPARATUS

(75) Inventors: Masaki Kataoka, Kanagawa (JP); Jun Isozaki, Kanagawa (JP); Hiroshi Shibata, Kanagawa (JP)

(73) Assignees: Fuji Xerox Co., Ltd., Tokyo (JP); Fujifilm Corporation, Tokyo (JP)

( * ) Notice: Subject to any disclaimer, the term of this patent is extended or adjusted under 35 U.S.C. 154(b) by 0 days.

(21) Appl. No.: 13/304,853

(22) Filed: Nov. 28, 2011

(65) Prior Publication Data

US 2012/0162331 A1 Jun. 28, 2012

(30) Foreign Application Priority Data

Dec. 27, 2010 (JP) ..... 2010-289257

(51) Int. Cl.
*B41J 2/175* (2006.01)
*B41J 2/18* (2006.01)

(52) U.S. Cl.
USPC ..... 347/84; 347/85; 347/89

(58) Field of Classification Search
USPC ..... 347/5, 84, 85, 89
See application file for complete search history.

(56) References Cited

U.S. PATENT DOCUMENTS

| | | | | |
|---|---|---|---|---|
| 6,428,156 | B1 | 8/2002 | Waller et al. | |
| 7,401,907 | B2 * | 7/2008 | Perez | 347/84 |
| 8,128,212 | B2 * | 3/2012 | Katada et al. | 347/89 |
| 8,141,973 | B2 * | 3/2012 | Hamazaki et al. | 347/11 |
| 8,256,855 | B2 | 9/2012 | Yamada | |
| 8,272,719 | B2 * | 9/2012 | Inoue et al. | 347/85 |
| 2005/0057627 | A1 | 3/2005 | De Marco et al. | |
| 2009/0174735 | A1 | 7/2009 | Yamada | |
| 2009/0284563 | A1 | 11/2009 | Bansyo | |
| 2009/0295888 | A1 | 12/2009 | Nitta et al. | |
| 2010/0026739 | A1 | 2/2010 | Hirashima | |
| 2010/0085396 | A1 | 4/2010 | Yokota et al. | |
| 2010/0177148 | A1 | 7/2010 | Asami | |
| 2010/0214334 | A1 | 8/2010 | Kusunoki et al. | |

FOREIGN PATENT DOCUMENTS

| | | |
|---|---|---|
| EP | 2098372 | 9/2009 |
| EP | 2127883 | 12/2009 |
| JP | 2003-191498 | 7/2003 |
| JP | 2009-160807 | 7/2009 |
| JP | 2010-064477 | 3/2010 |
| JP | 2010-083021 | 4/2010 |
| JP | 2010-158878 | 7/2010 |
| WO | 2010/118225 | 10/2010 |

OTHER PUBLICATIONS

Japanese Office Action in JP2010-289257 and English Translation , Nov. 24, 2009.
English language abstract for JP2010-083021 , Apr. 15, 2010.
English language abstract for JP2009-160807 , Jul. 23, 2009.
English language abstract for JP2003-191498 , Jul. 8, 2003.

* cited by examiner

*Primary Examiner* — Ahn T. N. Vo
(74) *Attorney, Agent, or Firm* — Fildes & Outland, P.C.

(57) ABSTRACT

A liquid circulating apparatus includes a liquid discharging unit for having a nozzle, a supply path, a recovery path, first and second pressure adjusting units, an opening/closing valve and a circulation controlling unit. The circulation controlling unit controls the first and second pressure adjusting units and the opening/closing valve to circulate the liquid by causing a differential pressure between the liquid at a supply side and at a recovery side with respect to the nozzle while the liquid maintains a meniscus in the nozzle. The circulation controlling unit (i) makes a differential pressure between the liquid of the supply path and the recovery path to be lower than the differential pressure in middle of the circulation while the opening/closing valve is closed when the liquid starts circulating, (ii) opens the opening/closing valve, and (iii) changes the differential pressure to the differential pressure in middle of the circulation.

11 Claims, 18 Drawing Sheets

DIFFERENTIAL PRESSURE ON NOZZLE SURFACE $\Delta P = (Pout + hout \times g \times \rho) - (Pin + hin \times g \times \rho)$ BACK PRESSURE ON NOZZLE SURFACE $Pnzl = (Pin + hin \times g \times \rho + Pout + hout \times g \times \rho) / 2$

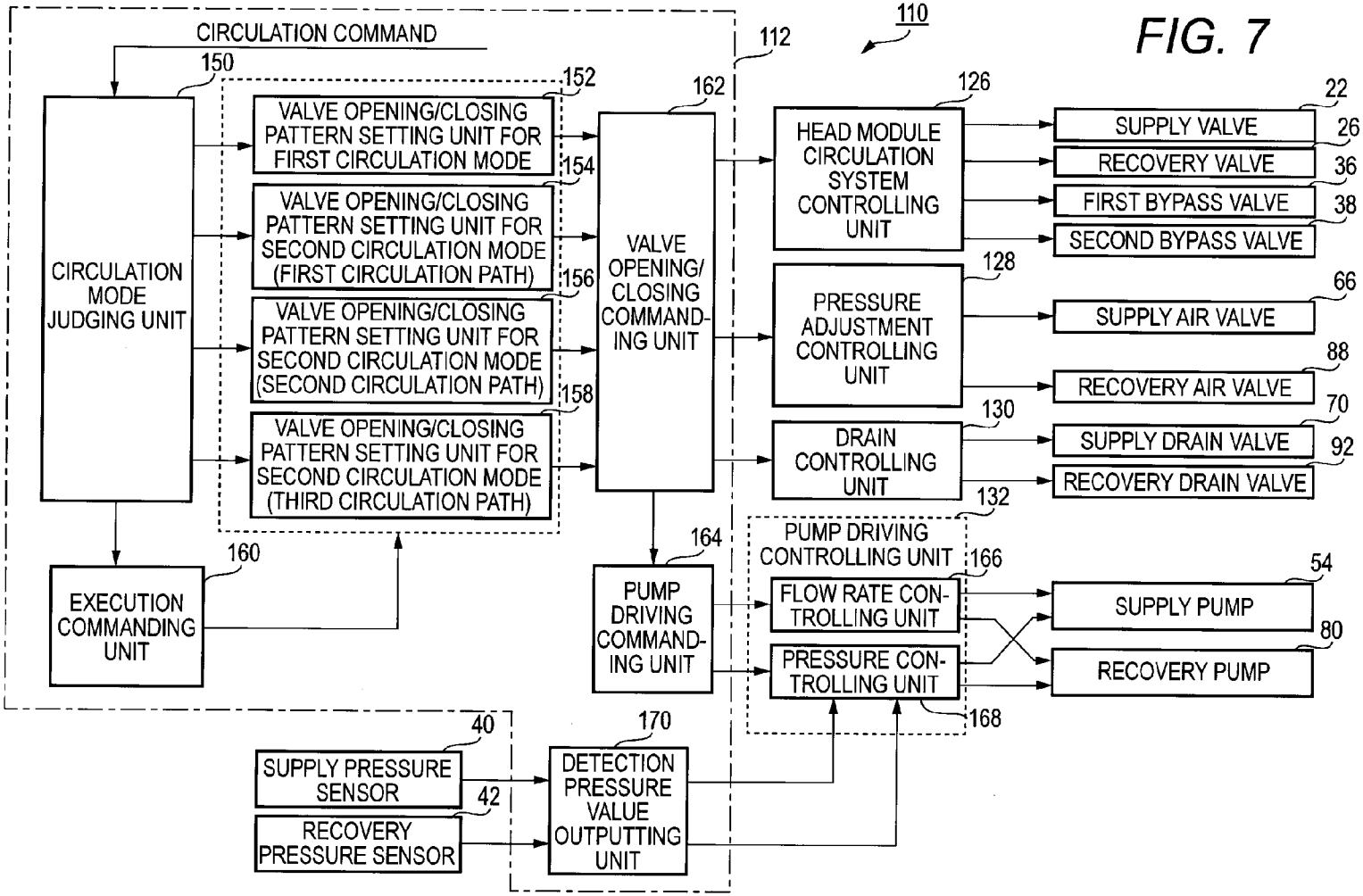
FIG. 7
110
112
CIRCULATION COMMAND
150
CIRCULATION MODE JUDGING UNIT
152
VALVE OPENING/CLOSING PATTERN SETTING UNIT FOR FIRST CIRCULATION MODE
154
VALVE OPENING/CLOSING PATTERN SETTING UNIT FOR SECOND CIRCULATION MODE (FIRST CIRCULATION PATH)
156
VALVE OPENING/CLOSING PATTERN SETTING UNIT FOR SECOND CIRCULATION MODE (SECOND CIRCULATION PATH)
158
VALVE OPENING/CLOSING PATTERN SETTING UNIT FOR SECOND CIRCULATION MODE (THIRD CIRCULATION PATH)
160
EXECUTION COMMANDING UNIT
162
VALVE OPENING/CLOSING COMMANDING UNIT
164
PUMP DRIVING COMMANDING UNIT
126
HEAD MODULE CIRCULATION SYSTEM CONTROLLING UNIT
128
PRESSURE ADJUSTMENT CONTROLLING UNIT
130
DRAIN CONTROLLING UNIT
132
PUMP DRIVING CONTROLLING UNIT
166
FLOW RATE CONTROLLING UNIT
168
PRESSURE CONTROLLING UNIT
22
SUPPLY VALVE
26
RECOVERY VALVE
36
FIRST BYPASS VALVE
38
SECOND BYPASS VALVE
66
SUPPLY AIR VALVE
88
RECOVERY AIR VALVE
70
SUPPLY DRAIN VALVE
92
RECOVERY DRAIN VALVE
54
SUPPLY PUMP
80
RECOVERY PUMP
40
SUPPLY PRESSURE SENSOR
42
RECOVERY PRESSURE SENSOR
170
DETECTION PRESSURE VALUE OUTPUTTING UNIT

FIG. 8

118

ROM

| CIRCULATION MODE / VALVE NAME | FIRST CIRCULATION MODE | SECOND CIRCULATION MODE | | |
|---|---|---|---|---|
| | | FIRST CIRCULATION PATH | SECOND CIRCULATION PATH | THIRD CIRCULATION PATH |
| SUPPLY VALVE 22 | OPENED | CLOSED | CLOSED | CLOSED |
| RECOVERY VALVE 26 | OPENED | CLOSED | CLOSED | CLOSED |
| FIRST BYPASS VALVE 36 | CLOSED | OPENED | CLOSED | CLOSED |
| SECOND BYPASS VALVE 38 | OPENED | CLOSED | CLOSED | CLOSED |
| SUPPLY AIR VALVE 66 | CLOSED | CLOSED | CLOSED | CLOSED |
| RECOVERY AIR VALVE 88 | CLOSED | CLOSED | CLOSED | CLOSED |
| SUPPLY DRAIN VALVE 70 | CLOSED | CLOSED | OPENED | CLOSED |
| RECOVERY DRAIN VALVE 92 | CLOSED | OPENED | CLOSED | OPENED |

(FIG. 10 Continued)
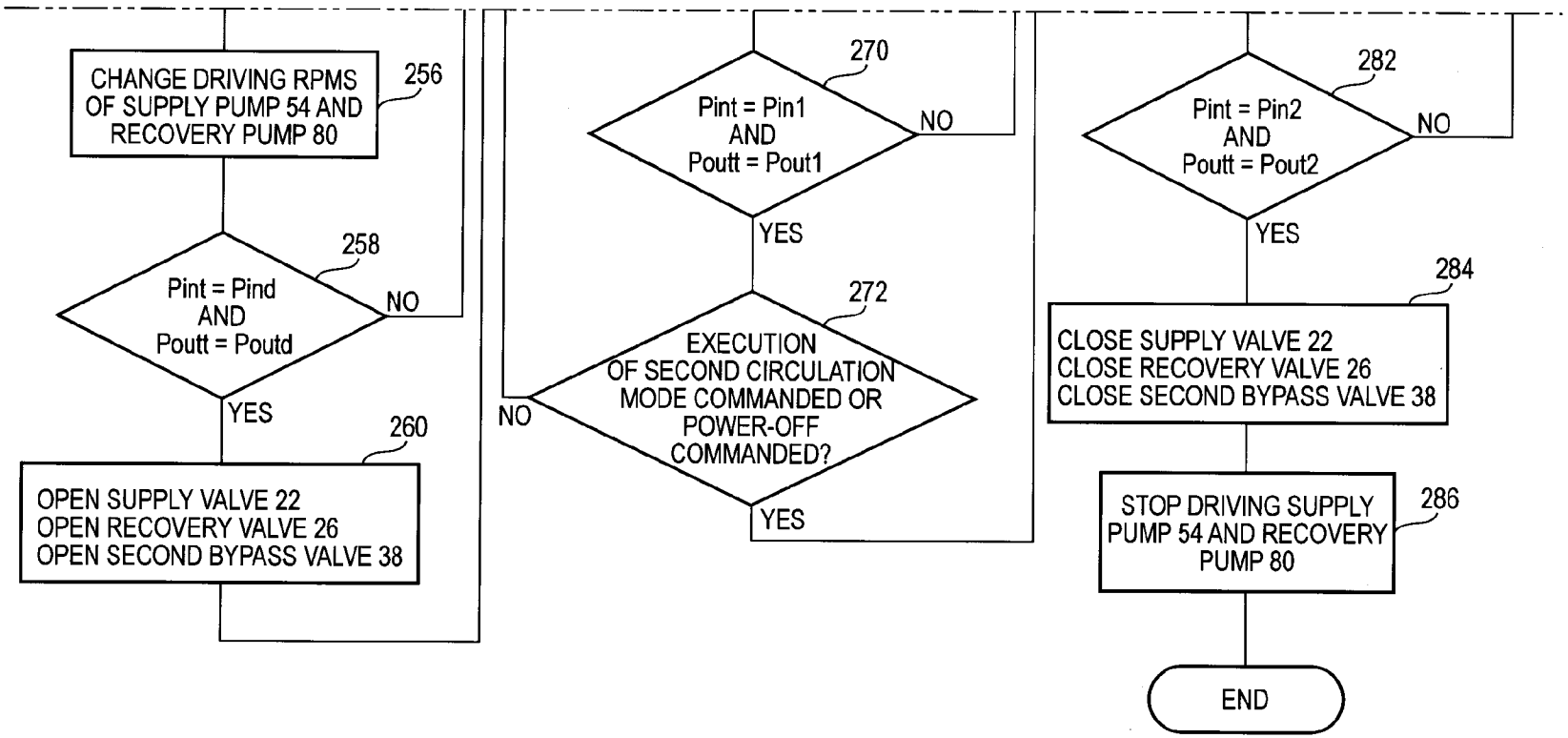

LIQUID CIRCULATING APPARATUS, COMPUTER-READABLE MEDIUM, AND LIQUID DISCHARGING APPARATUS

CROSS-REFERENCE TO RELATED APPLICATION

This application is based on and claims priority under 35 USC 119 from Japanese Patent Application No. 2010-289257 filed Dec. 27, 2010.

BACKGROUND

1. Technical Field

The present invention relates to a liquid circulating apparatus, a computer-readable medium, and a liquid discharging apparatus.

2. Related Art

There have been known, for example, apparatuses as liquid circulating apparatuses that circulate a liquid (ink) discharged from a nozzle of a liquid discharger.

SUMMARY (1) According to an aspect of the invention, a liquid circulating apparatus includes a liquid discharging unit, a supply path, a recovery path, a first pressure adjusting unit, a second pressure adjusting unit, an opening/closing valve and a circulation controlling unit. The liquid discharging unit has a nozzle which discharges a liquid. The supply path supplies a liquid to the liquid discharging unit. The recovery path recovers a liquid from the liquid discharging unit. The first pressure adjusting unit adjusts a pressure of the liquid in the supply path. The second pressure adjusting unit adjusts a pressure of the liquid in the recovery path. The opening/closing valve is provided at least one of the supply path and the recovery path to open/close the path. The circulation controlling unit controls the first pressure adjusting unit, the second pressure adjusting unit and the opening/closing valve to circulate the liquid by causing a differential pressure between the liquid at a supply side and the liquid at a recovery side with respect to the nozzle while the liquid maintains a meniscus in the nozzle. The circulation controlling unit (i) makes a differential pressure between the liquid of the supply path and the liquid of the recovery path to be lower than the differential pressure in middle of the circulation while the opening/closing valve is closed when the liquid starts circulating with respect to the nozzle, (ii) opens the opening/closing valve, and (iii) changes the differential pressure to the differential pressure in middle of the circulation.

BRIEF DESCRIPTION OF THE DRAWINGS

Exemplary embodiments of the invention will be described in detail based on the following figures, wherein:

FIGS. 6A, 6B and 6C are piping diagrams of FIG. 1, in which FIG. 6A is a piping diagram illustrating a first circulation path in a second ink circulation mode, FIG. 6B is a piping diagram illustrating a second circulation path in the second ink circulation mode, and FIG. 6C is a piping diagram illustrating a third circulation path in the second ink circulation mode;

FIG. 7 is a functional block diagram for executing an ink circulation system program;

FIG. 8 is a conceptual diagram of a ROM 118 storing a valve opening/closing pattern table 118A in the first circulation mode and the second circulation mode (first to third circulation paths);

FIG. 9 is a flowchart illustrating a main routine for circulation control which starts when power is on;

FIGS. 12A and 12B are explanatory diagrams illustrating changes in supply pressure and recovery pressure when circulation starts in the first ink circulation mode, in which FIG. 12A is an explanatory diagram illustrating changes in the related art and FIG. 12B is an explanatory diagram illustrating changes in the embodiment;

FIGS. 13A and 13B are explanatory diagrams illustrating changes in supply pressure and recovery pressure in the first ink circulation mode, in which FIG. 13A is an explanatory diagram illustrating changes when circulation starts and FIG. 13B is an explanatory diagram illustrating changes when circulation ends;

DETAILED DESCRIPTION

Overall Configuration

In an embodiment, as one example of a liquid droplet discharging apparatus that discharges a liquid droplet, an inkjet recording apparatus will be described which records an image on a recording medium by discharging ink droplets.

Meanwhile, the liquid droplet discharging apparatus is not limited to the inkjet recording apparatus. The liquid droplet discharging apparatus may include, for example, a color filter manufacturing apparatus that manufactures a color filter by discharging ink onto a film or glass, an apparatus for forming an EL display panel by discharging an organic EL solution onto a substrate, an apparatus for forming a bump for mounting components by discharging a soluble state solder onto the substrate, an apparatus for forming a wiring pattern by discharging a liquid containing metal, and various film forming apparatuses for forming a film by discharging the liquid droplets. As the liquid droplet discharging apparatus, any apparatuses that discharge the liquid droplets may be used.

Figure 17:
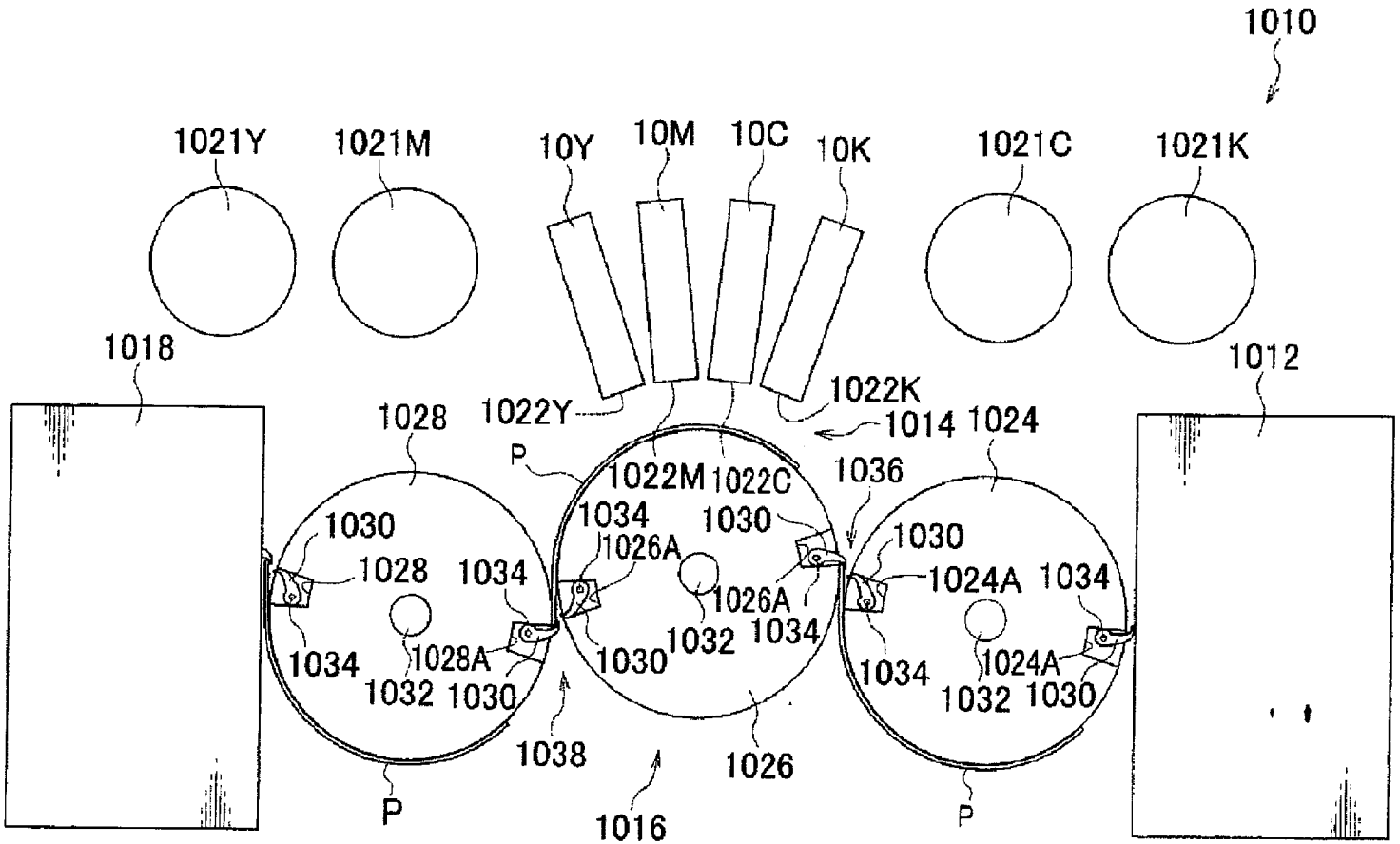
FIG. 17 is a schematic diagram illustrating a configuration of an inkjet recording apparatus according to an embodiment.

FIG. 17 is a schematic diagram illustrating a configuration of an inkjet recording apparatus according to an embodiment.

As shown in FIG. 17, an inkjet recording apparatus 1010 includes a recording medium accommodating unit 1012 that accommodates a recording medium P such as paper, an image recording unit 1014 that records an image on the recording medium P, a conveying module 1016 that conveys the recording medium P to the image recording unit 1014 from the recording medium accommodating unit 1012, and a recording medium discharging unit 1018 that discharges the recording medium P on which the image is recorded by the image recording unit 1014.

The image recording unit 1014 includes inkjet heads 10Y, 10M, 10C, and 10K (hereinafter, referred to as "10Y to 10K") which records the image on the recording medium by discharging the ink droplets, as an example of a liquid droplet discharging head discharging the liquid droplets.

The inkjet heads 10Y to 10 K has nozzle surfaces 1022Y, 1022M, 1022C, and 1022K (hereinafter, referred to as "1022Y to 1022K") on which nozzles 11 (see FIG. 4) are formed, respectively. The nozzle surfaces 1022Y to 1022K have recordable areas having widths which are equal to or larger than the maximum width of the recording medium P on which the image is supposed to be recorded in the inkjet recording apparatus 1010.

The inkjet heads 10Y to 10K are arranged in parallel in the color order of yellow Y, magenta M, cyan C, and black K from a downstream side in a conveyance direction of the recording medium P and discharge ink droplets corresponding to the respective colors from the plurality of nozzles 11 by a piezoelectric method to record the image. Meanwhile, the inkjet heads 10Y to 10K may discharge the ink droplets by using other methods such as a thermal method as the configuration of discharging the ink droplets.

Ink tanks 1021Y, 1021M, 1021C, and 1021K (hereinafter, referred to as "1021Y to 1021K") storing ink of each color are installed in the inkjet recording apparatus 1010 as a storing unit storing a liquid. The ink is supplied to each of the inkjet heads 10Y to 10K from the ink tanks 1021Y to 1021K. Meanwhile, as the ink supplied to the inkjet heads 10Y to 10K, various ink such as aqueous ink, oil-based ink, and solvent ink may be used.

The conveying module 1016 includes an ejection drum 1024 that ejects the recording medium P in the recording medium accommodating unit 1012 one by one, a conveyance drum 1026 as a conveyor that conveys the recording medium P to the inkjet heads 10Y to 10K of the image recording unit 1014 to allow the recording surface to face the inkjet heads 10Y to 10K, and a delivery drum 1028 that delivers the recording medium P recorded with the image to the recording medium discharging unit 1018. The ejection drum 1024, the conveyance drum 1026, and the delivery drum 1028 are configured to hold the recording medium P on each circumferential surface thereof by an electrostatic adsorption module or a non-electrostatic adsorption module such as suction or adhesion.

Two sets of grippers 1030 as a holding module that picks up and holds a downstream end in the conveyance direction of the recording medium P are provided in each of the ejection drum 1024, the conveyance drum 1026, and the delivery drum 1028. In this case, the three drums 1024, 1026, and 1028 are configured to hold up to two sheets of recording media P on the circumferential surfaces thereof by using the grippers 1030. The grippers 1030 are installed in two sets of concave portions 1024A, 1026A, and 1028A on the circumferential surface of each of the drums 1024, 1026, and 1028.

Specifically, a rotational shaft 1034 is supported on a rotational shaft 1032 of each drum 1024, 1026, or 1028 at a predetermined position in the concave portion 1024A, 1026A, or 1028A of each drum 1024, 1026, or 1028. The plurality of grippers 1030 are fixed to the rotational shaft 1034 at an interval in a shaft direction. Therefore, the rotational shaft 1034 is rotated in both forward and backward directions by an actuator (not shown), such that the grippers 1030 rotate in both forward and backward directions in a circumferential direction of each drum 1024, 1026, or 1028 to hold or separate the conveyance-direction downstream end of the recording medium P.

That is, a front end of the gripper 1030 rotates while being slightly protruded on the circumferential surface of each drum 1024, 1026, or 1028, such that the recording medium P is transferred from the gripper 1030 of the ejection drum 1024 to the gripper 1030 of the conveyance drum 1026 at a transfer position 1036 where the circumferential surface of the ejection drum 1024 and the circumferential surface of the conveyance drum 1026 face each other and the recording medium P is transferred from the gripper 1030 of the conveyance drum 1026 to the gripper 1030 of the delivery drum 1028 at a transfer position 1038 where the circumferential surface of the conveyance drum 1026 and the circumferential surface of the delivery drum 1028 face each other.

The inkjet recording apparatus 1010 includes a maintenance unit (not shown) that maintains the inkjet heads 10Y to 10K. The maintenance unit includes a cap that covers the nozzle surfaces of the inkjet heads 10Y to 10K, an accommodation member that receives liquid droplets which are preliminarily discharged (dummy-discharged), a clean-up member that cleans up the nozzle surfaces, and a suction device that sucks ink in the nozzle 11. The maintenance unit moves to a position facing each of the inkjet heads 10Y to 10K to perform various maintenances.

Subsequently, an image recording operation of the inkjet recording apparatus 1010 will be described.

The recording medium P held by being drawn out from the recording medium accommodating unit 1012 by the gripper 1030 of the ejection drum 1024 one by one is conveyed while being adsorbed onto the circumferential surface of the ejection drum 1024 to be transferred from the gripper 1030 of the ejection drum 1024 to the gripper 1030 of the conveyance drum 1026 at the transfer position 1036.

The recording medium P held by the gripper 1030 of the conveyance drum 1026 is conveyed up to the image recording positions of the inkjet heads 10Y to 10K while being adsorbed on the conveyance drum 1026, such that the image is recorded on the recording surface with the ink droplets discharged from the inkjet heads 10Y to 10K.

The recording medium P in which the image is recorded on the recording surface is transferred from the gripper 1030 of the conveyance drum 1026 to the gripper 1030 of the delivery drum 1028 at the transfer position 1038. The recording medium P held by the gripper 1030 of the delivery drum 1028 is conveyed while being adsorbed on the delivery drum 1028 to be discharged to the recording medium discharging unit 1028.

As described above, a series of image recording operations are performed.

(Piping Configuration)

Figure 1:
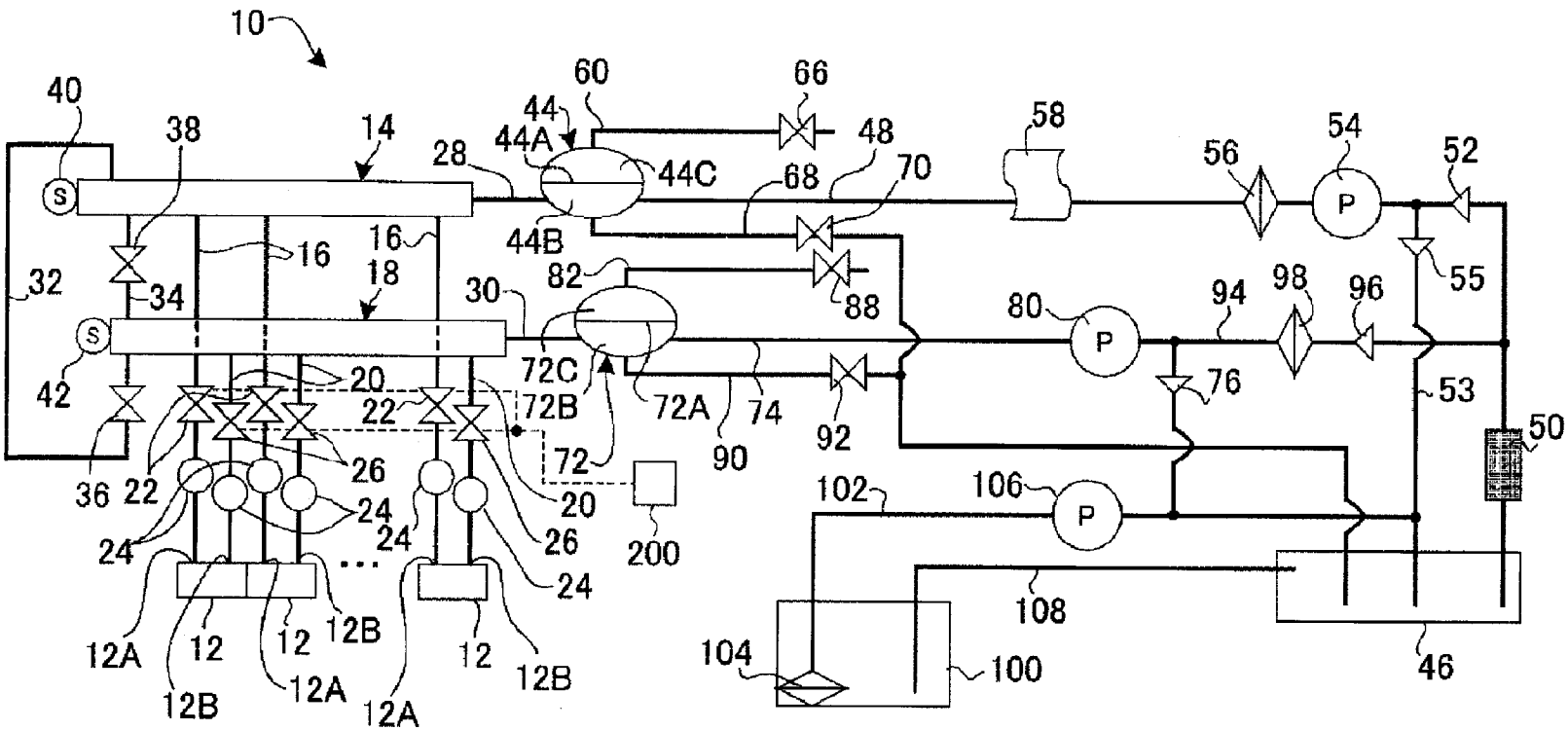
FIG. 1 is a piping diagram of an inkjet head of an inkjet recording apparatus according to an embodiment.

FIG. 1 shows a piping diagram of an inkjet head 10 of an inkjet recording apparatus 1010 according to an embodiment. The piping diagram shown in FIG. 1 relates to ink of one color among respective colors, for example, a yellow color. Piping configurations of ink of other colors are also the same as the above piping configuration of the yellow ink.

A plurality of liquid discharging units 12 (hereinafter, referred to as 'head modules') are attached to the inkjet head 10 of the present embodiment. Ink circulating piping paths for supplying ink to the respective head modules 12 uniformly (at a predetermined pressure and a predetermined flow rate) are formed in the inkjet head 10.

As shown in FIG. 1, an input port 12A which ink flows in and an output port 12B through which ink is discharged are installed in the head module 12. A front end of a supply branch pipe 16 branched from a supply manifold 14 is attached to the input port 12A and a front end of a recovery branch pipe 20 branched from a recovery manifold 18 is attached to the output port 12B. That is, the branch pipes (the supply branch pipes 16 and the recovery branch pipes 20) are installed in the supply manifold 14 and the recovery manifold 18 as many as the installed head modules 12 to supply ink supplied to the supply manifold 14 to each head module 12 at a predetermined pressure $P_{in}$ and a predetermined flow rate and to recover the ink supplied to the head module 12 from each head module 12 to the recovery manifold 18 at a predetermined pressure $P_{out}$ and a predetermined flow rate.

That is, a different pressure $\Delta P$ is generated in the head module 12 by the pressure $P_{in}$ of the supply manifold 14 and the pressure $P_{out}$ of the recovery manifold 18, and as a result, ink flows between the input port 12A and the output port 12B in the head module 12 and fresh ink is supplied to the head module 12 at all times by the flow. A back pressure $P_{nzl}$ that depends on the pressure $P_{in}$ of the supply manifold 14 and the pressure $P_{out}$ of the recovery manifold 18 is applied to a nozzle surface which is an ink discharging opening. The back pressure $P_{nzl}$ will be described below in detail.

A supply valve 22 as an example of an opening/closing valve and a buffer 24 are interposed in the supply branch pipe 16. A recovery valve 26 as an example of the opening/closing valve and the buffer 24 are interposed in the recovery branch pipe 20. The supply valve 22 and the recovery valve 26 are opened and closed when the head modules 12 need to be individually operated and when ink circulation starts or ends with respect to the head module 12 as described below. The buffer 24 serves to buffer fluctuation in pressure when the ink supplied from the supply manifold 14 or the ink recovered to the recovery manifold 18 flows.

One end portion of a supply pipe 28 of an ink circulation piping system is attached to one longitudinal end portion (a right end portion of FIG. 1) of the supply manifold 14, while one end portion of a recovery pipe 30 of the ink circulation piping system is attached to one longitudinal end portion (a right end portion of FIG. 1) of the recovery manifold 18.

A first bypass path 32 and a second bypass path 34 as one example of a bypass path are installed between the other end portions (left end portions of FIG. 1) of the supply manifold 14 and the recovery manifold 18. A first bypass valve 36 is interposed in the first bypass path 32. A second bypass valve 38 as one example of a bypass path opening/closing valve is interposed in the second bypass path 34. The first bypass path 32 and the second bypass path 34 are used to adjust the pressure and flow rate between the supply manifold 14 and the recovery manifold 18. For example, during first circulation (the flow from the supply manifold 14 to the recovery manifold 18) to be described below, the first bypass valve 36 is closed and the second bypass valve 38 is opened, such that only the second bypass path 34 is open.

A supply pressure sensor 40 and a recovery pressure sensor 42 are attached to the other end portions of the supply manifold 14 and the recovery manifold 18, respectively to monitor the pressures of inks in the supply manifold 14 and the recovery manifold 18.

The other end portion of the supply pipe 28 connected to the supply manifold 14 is connected to a supply subtank 44. The supply subtank 44 as a 2-chamber structure is partitioned by a thin film member 44A having elasticity and one of the partitioned subtanks is an ink subtank chamber 44B and the other one is an air chamber 44C.

One end portion of a supply main pipe 48 for drawing in ink from a buffer tank 46 (and recovering the ink to the buffer tank 46) is connected to the ink subtank chamber 44B. An opening of the other end portion of the supply main pipe 48 is immersed in ink stored in the buffer tank 46.

A degassing module 50, a one-way valve 52, a supply pump 54 as one example of a first pressure adjusting module, a supply filter 56, and an ink temperature adjuster 58 are interposed in the supply main pipe 48 sequentially from the buffer tank 46 to the supply subtank 44. Air bubbles are removed from the ink and the temperature of the ink is managed by driving force of the supply pump 54 while the ink stored in the buffer tank 46 is supplied to the supply subtank 44.

Meanwhile, one end portion of the branch pipe 53 is connected to an inlet of the supply pump 54 apart from the supply main pipe 48 and the other opening of the branch pipe 53 is immersed in the ink stored in the buffer tank 46 through a one-way valve 55.

The supply pump 54 according to the embodiment is a tube pump (while a tube having elasticity is scrubbed out through rotation by a stepping motor, the ink in the tube is supplied) using the stepping motor, but is not particularly limited to the pressure adjusting module (pump). In other words, as the supply pump 54, a module that can adjust the pressure of ink at the supply side to a high pressure and a low pressure by forward and backward rotation. Meanwhile, hereinafter, the driving revolution per unit (RPM) of the pump is represented to be equal to that of the stepping motor.

An open pipe 60 is attached to the air chamber 44C of the supply subtank 44. A supply air valve 66 is interposed in the open pipe 60.

The ink subtank chamber 44B is connected with one end of a drain pipe 68. An opening of the other end of the drain pipe 68 is immersed in the ink stored in the buffer tank 46. A supply drain valve 70 is interposed in the drain pipe 68.

The supply subtank 44 serves to adjust and maintain the pressure in the ink subtank chamber 44B to a desired value by using the air chamber 44C and the thin film member 44A.

Meanwhile, the other end portion of the recovery pipe 30 connected to the recovery manifold 18 is connected to a recovery subtank 72. The recovery subtank 72 as a 2-chamber structure is partitioned by a thin film member 72A having elasticity and one of the partitioned subtanks is an ink subtank chamber 72B and the other one is an air chamber 72C.

One end portion of a recovery main pipe 74 for drawing in ink from the buffer tank 46 (and recovering the ink to the buffer tank 46) is connected to the ink subtank chamber 72B.

A one-way valve 76 is interposed in the recovery main pipe 74 and the ink in the recovery subtank 72 is recovered to the buffer tank 46 by using the driving force of a recovery pump 80 as one example of a second pressure adjusting module. The recovery pump 80 is also constituted by the tube pump of the same type as the supply pump 54.

An open pipe 82 is attached to the air chamber 72C of the recovery subtank 72. A recovery air valve 88 is interposed in the open pipe 82.

The ink subtank chamber 72B is connected with one end of a drain pipe 90. The other end of the drain pipe 90 is connected to the drain pipe 68 of the supply subtank 44 through a recovery drain valve 92.

The recovery subtank 72 serves to adjust and maintain the pressure in the ink subtank chamber 72B to a desired value by using the air chamber 72C and the thin film member 72A.

Figure 4:
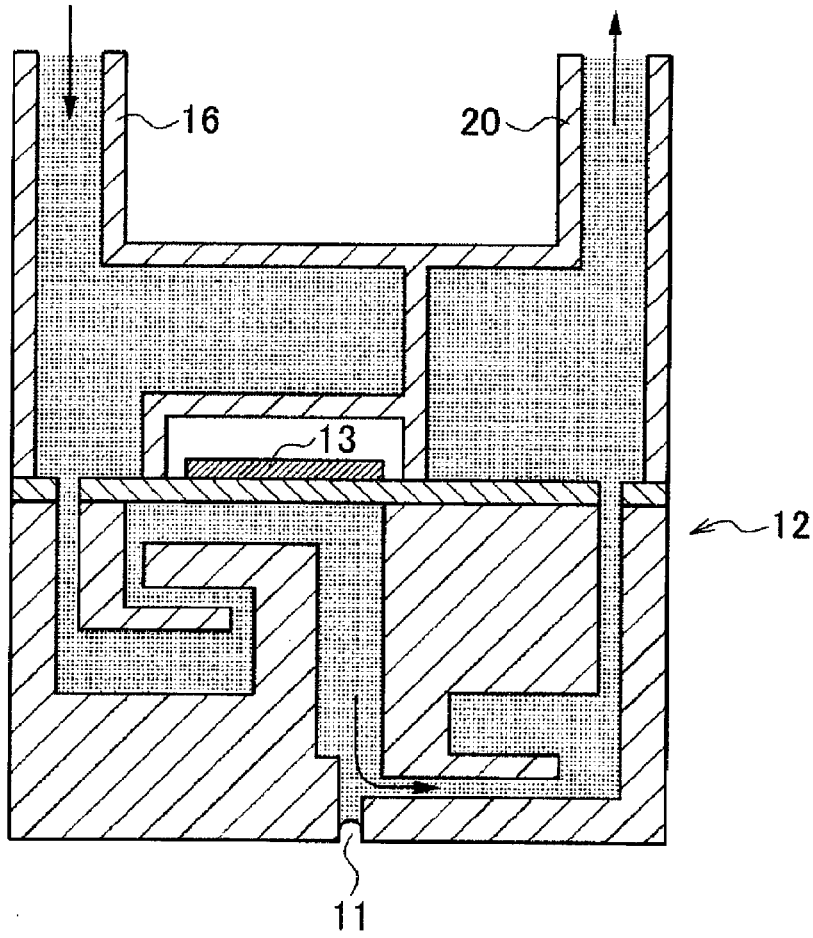
FIG. 4 is a cross-sectional view of a head module shown in FIG. 3.

However, in a first circulation mode of the present embodiment, in the case of the pressures by the supply pump 54 and the recover pump 80, the pressure $P_{in}$ of the supply manifold 14 is greater than the pressure $P_{out}$ of the recovery manifold 18. Both pressures are negative pressures. That is, the supply pressure of the supply pump 54 is the negative pressure, but the recovery pressure of the recovery pump 80 is the lower negative pressure, and as a result, ink flows from the supply manifold 14 to the recovery manifold 18 and the back pressure $P_{nzl}$ of the nozzle 11 of the head module 12 is maintained as a negative pressure. Therefore, as shown in FIG. 4, while the ink maintains the meniscus in the nozzle 11 of the head module 12, the ink circulates with respect to the nozzle 11. Meanwhile, the ink can maintain the meniscus in the nozzle 11 at the back pressure $P_{nzl}$ in the range of −2,000 Pa(G) to +1,000 Pa(G) ('(G)' represents a gauge pressure (a pressure of which reference is an atmospheric pressure, and a relative pressure) in the present embodiment even though the pressure range varies depending on a specification of the head module 12 or an ink type.

Meanwhile, in the present embodiment, a pressurization purge pipe 94 is installed, which is connected between the inlet of the recovery pump 80 and the outlet of the degassing module 50 in the supply main pipe 48.

A one-way valve 96 and a recovery filter 98 are interposed sequentially from the degassing module 50 to the recovery pump 80 in the pressurization purge pipe 94.

That is, when ink is discharged with one rush by pressurizing the inside of the head module 12 to remove the air bubbles, the ink is supplied from the buffer tank 46 to the recovery manifold 18 by reversing a driving direction of the recovery pump 80 against a normal driving direction in addition to the driving of the supply pump 54. Meanwhile, the drain pipes 68 and 90 are used to discharge the ink.

The buffer tank 46 is connected to a main tank 100 (corresponding to the ink tanks 1021Y, 1021M, 1021C, and 1021K shown in FIG. 17). That is, the amount of ink required to circulate ink is stored in the buffer tank 46, and ink is refilled from the main tank 100 as ink is consumed. That is, one end portion of a refill pipe 102 is immerged in the ink stored in the main tank 100. A filter 104 is attached to an opening of the one end of the refill pipe 102 which is immersed. The refill pipe 102 is connected to an inlet of a refill pump 106. An outlet of the refill pump 106 is connected to the middle of the branch pipe 53, which is piped to the buffer tank 46. Herein, the refill pump 106 is driven to refill ink in the buffer tank 46. Meanwhile, an overflow pipe 108 is installed between the buffer tank 46 and the main tank 100, such that ink is recovered to the main tank 100 when ink is over-refilled.

An emergency power supply 200 capable of supplying power for operating the supply valve 22 and the recovery valve 26 is provided in the inkjet head 10.

(Configuration of Control System)

Figure 2:
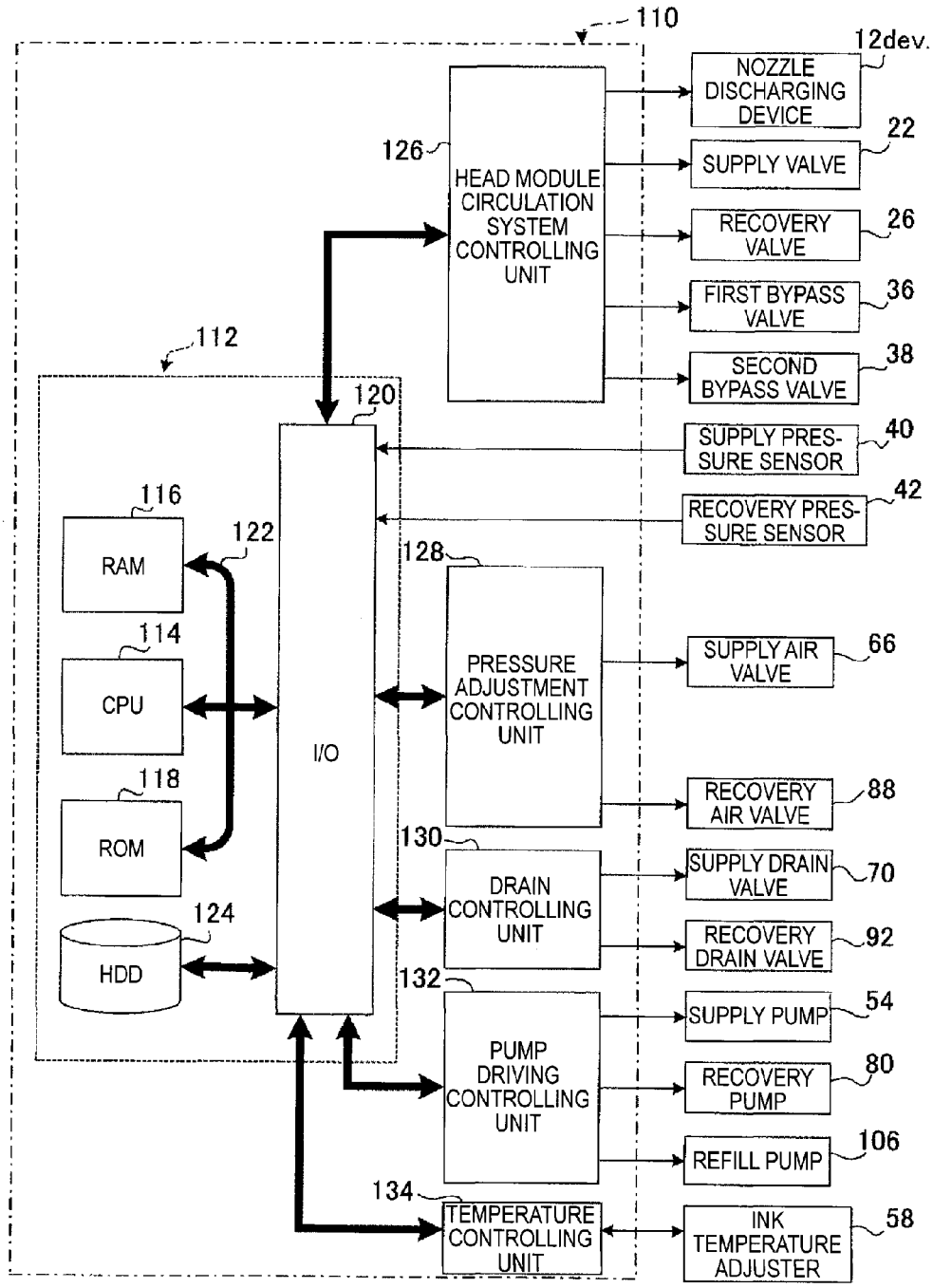
FIG. 2 is a block diagram of an ink supply controlling apparatus for controlling an operation in the inkjet head of FIG. 1.

FIG. 2 is a block diagram of an ink supply controlling apparatus 110 for controlling an operation in the inkjet head 10 according to the present embodiment.

The ink supply controlling apparatus 110 includes a microcomputer 112. The microcomputer 112 includes a CPU 114, a RAM 116, a ROM 118, an I/O 120, and a bus 122 such as a data bus or a control bus that connects the CPU 114, the RAM 116, the ROM 118, and the I/O 120.

A hard disk drive (HDD) 124 is connected to the I/O 120. The supply pressure sensor 40 and the recovery pressure sensor 42 are connected to the I/O 120.

Although not shown, image data when an image is formed by discharging ink from the nozzle 11 of the head module 12 is inputted into the I/O 120. Meanwhile, the image data may be a state (raster data) in which an ink discharge position or an ink discharge amount is determined or compressed data such as JPEG. In case of the compressed data, the image data is converted into data (raster data) for discharging ink by the CPU 114. In the CPU 114, an ink circulation system program stored in the ROM 118 is read and executed. In the ROM 118, at least control programs to be described below are stored as an ink circulation control type (hereinafter, may be referred to as a 'mode' as a synonym of a 'control type').

(First Ink Circulation Mode)

A circulation control program (program 1) for circulating the ink in the buffer tank 46 with respect to the nozzle 11 of the head module 12 by allowing the ink in the buffer tank 46 to flow toward the recovery manifold 18 from the supply manifold 14.

(Second Ink Circulation Mode)

A circulation control program (program 2) for discharging (purging) air bubbles in the ink supply path.

Meanwhile, the programs for executing the first ink circulation mode and the second ink circulation mode are not limited to be stored in the ROM 118, but the programs may be stored in the HDD 124, or an external storage medium, and thereafter, the stored program may be acquired by installing the external storage medium in which the programs are stored therein in advance, or a network such as a LAN (all not shown).

In the CPU 114, the circulation control programs are read, and based on the read circulation control programs, a head module circulation system controlling unit 126, a pressure adjustment controlling unit 130, a drain controlling unit 130, a pump driving controlling unit 132, and a temperature controlling unit 134 that are connected to the I/O 120 are operated.

A nozzle discharge device 13 (for example, a device that discharges ink droplets from the nozzle 11 by vibration of a pressure chamber through current conduction control of a piezoelectric device (see FIG. 4)) (12 dev), the supply valve 22, the recovery valve 26, a first bypass valve 36, and the second bypass valve 38, which are incorporated in the head module 12, are electrically connected to the head module circulation system controlling unit 126.

The supply air valve 66 and the recovery air valve 88 are electrically connected to the pressure adjustment controlling unit 128.

The supply drain valve 70 and the recovery drain valve 92 are electrically connected to the drain controlling unit 130.

The supply pump 54, the recovery pump 80, and the refill pump 106 are connected to the pump driving controlling unit 132. Meanwhile, in the present embodiment, rotational speeds of the supply pump 54, the recovery pump 80, and the refill pump 106 are expressed as the revolution per minute (rpm), but may be expressed by other factors such as a linear speed and an angular speed.

The ink temperature adjuster 58 is electrically connected to the temperature controlling unit 134.

(First Ink Circulation Mode)

Herein, in the above-mentioned first ink circulation mode (circulation control to circulate the ink in the buffer tank 46 with respect to the nozzle 11 of the head module 12 by allowing the ink in the buffer tank 46 to flow toward the recovery manifold 18 from the supply manifold 14, hereinafter, may be referred to as a 'first circulation mode'), the differential pressure ΔP between a supply side and a recovery side with respect to the nozzle 11 of the head module 12 is controlled to be constant. That is, the first ink circulation mode is executed by a pressure control (see FIG. 5).

Figure 5:
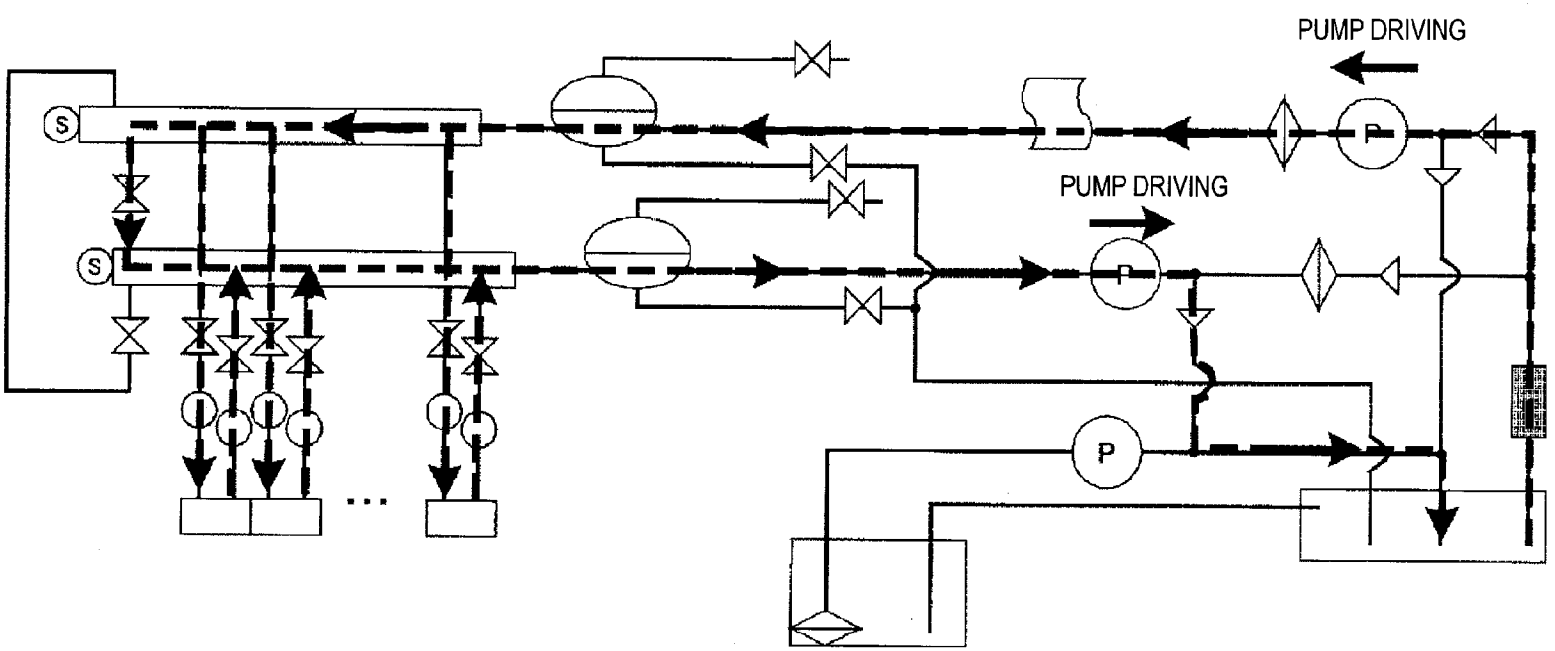
FIG. 5 is a piping diagram illustrating a circulation path in a first ink circulation mode, in the piping diagram of FIG. 1.

Meanwhile, FIG. 5 is the same as the piping diagram shown in FIG. 1, but reference numerals are omitted and the circulation path is expressed by a thick dashed line.

Figure 3:
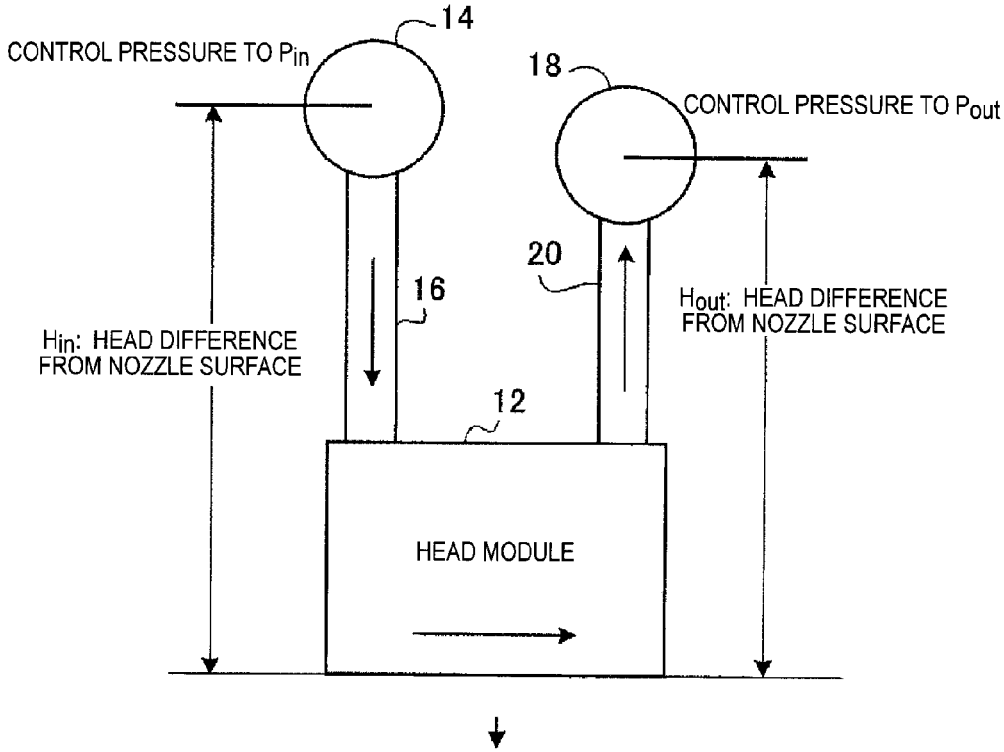
FIG. 3 is a schematic side view illustrating the pressure relationship between a supply manifold and a recovery manifold.

FIG. 3 is a schematic diagram of the differential pressure ΔP and the back pressure $P_{nzl}$.

As shown in FIG. 3, there is a difference between the height position of the supply manifold 14 and the height position of the recovery manifold 18 with reference to the head module 12. Therefore, head differences between the nozzle surface of the head module 12 with the height positions of the supply manifold 14 and the recovery manifold 18 are also different from each other. Herein, the head difference between the nozzle surface and the height position of the supply manifold 14 is represented by $h_{in}$ and the head difference between the nozzle surface and the height position of the recovery manifold 18 is represented by $h_{ont}$.

Ink is supplied to the supply manifold 14 at the pressure $P_{in}$ by the driving force of the supply pump 54 and ink is recovered to the recovery manifold 18 at the pressure $P_{out}$ by the driving force of the recovery pump 80. The pressures $P_{in}$ and $P_{out}$ in this case are the negative pressures and the pressure $P_{out}$ is the lower negative pressure than the pressure $P_{in}$.

Under the above condition, the back pressure $P_{nzl}$ on the nozzle surface of the head module 12 is represented by Equation 1 below.

Under the above condition, the differential pressure ΔP between the supply side and the recovery side is represented by Equation 2 below.

$$P_{nzl}=(P_{in}+h_{in}\times g\times\rho+P_{out}+h_{out}\times g\times\rho)/2 \quad (1)$$

$$\Delta P=(P_{out}+h_{out}\times g\times\rho)-(P_{in}+h_{in}\times g\times\rho) \quad (2)$$

wherein, $P_{nzl}$: Pressure (back pressure) on the nozzle surface of the head module 12

$P_{in}$: Pressure in the supply manifold 14

$P_{out}$: Pressure in the recovery manifold 18 g: Gravity acceleration

ρ: Ink density.

In Equations 1 and 2, the head differences $h_{in}$ and $h_{out}$, and the gravity acceleration g may be regarded as constants and when ink is not changed, the ink density ρ may also be regarded as a constant. Therefore, the differential pressure ΔP or the back pressure $P_{nzl}$ depends on the pressure $P_{in}$ in the supply manifold 14 and the pressure $P_{out}$ in the recovery manifold 18 and is adjusted by controlling the driving of the supply pump 54 and the recovery pump 80. Herein, for a simple description, a path resistance from the supply manifold 14 to the head module 12 and a path resistance from the head module 12 to the recovery manifold 18 are regarded as substantially ignorable values which are equivalent to each other.

(Second Ink Circulation Mode)

Meanwhile, in the second ink circulation mode (circulation control to discharge the air bubbles generated in the ink supply path, hereinafter, may be referred to as a 'second circulation mode'), at least three types of circulation paths (first to third circulation paths) on which no ink flows to the head module 12 are set and the three types of circulation paths are sequentially set, such that the flow rate is controlled by driving the supply pump 54 or the recovery pump 80, in the present embodiment (see FIGS. 6A to 6C).

(First Circulation Path)

Figure 6A:
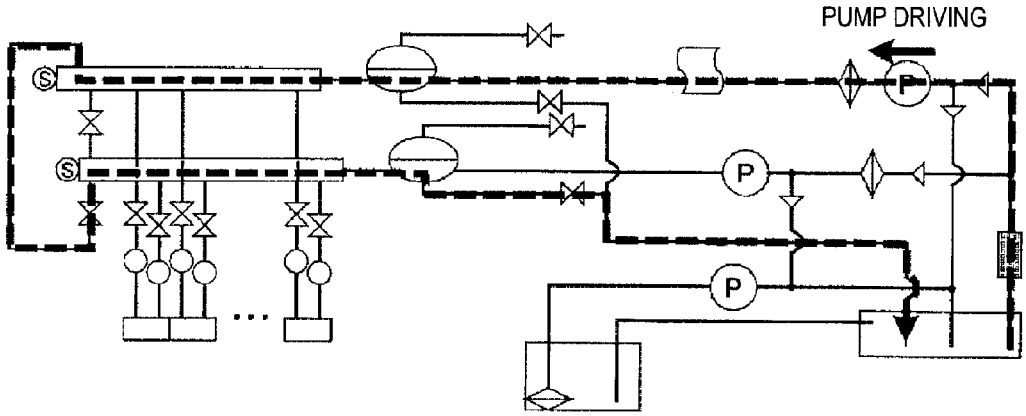

The path (the supply branch pipe 16) from the supply manifold 14 to the head module 12 and the path (the recovery branch pipe 20) from the head module 12 to the recovery manifold 18 are cut off (the supply valve 22 and the recovery valve 26 are closed) and the first bypass path 32 having a relatively larger inner diameter than the second bypass path 34 is opened to control the flow rate by driving the supply pump 54 (see FIG. 6A).

Meanwhile, FIG. 6A is the same as the piping diagram shown in FIG. 1, but reference numerals are omitted and the circulation path is also expressed by the thick dashed line.

(Second Circulation Path)

Figure 6B:
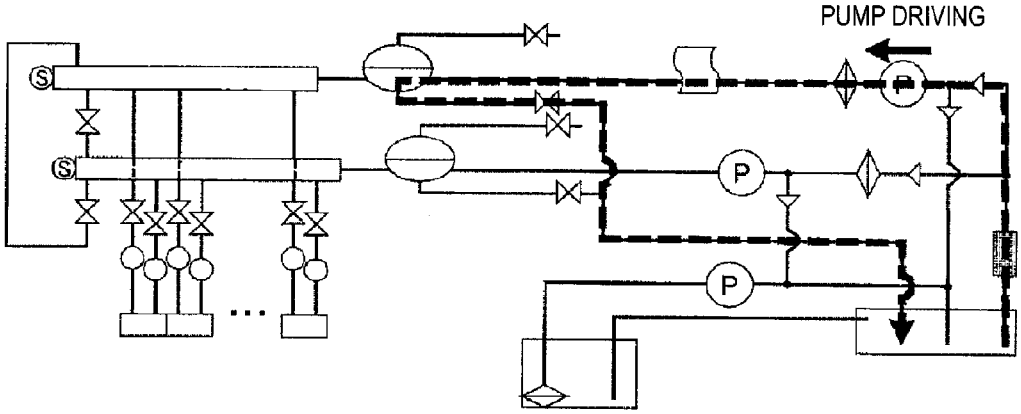

The supply main pipe 48 serves as a main body and the supply drain valve 70 installed in the drain pipe 68 is opened to control the flow rate by driving the supply pump 54 (see FIG. 6B).

Meanwhile, FIG. 6B is the same as the piping diagram as shown in FIG. 1, but reference numerals are omitted and the circulation path is also expressed by the thick dashed line.

(Third Circulation Path)

Figure 6C:
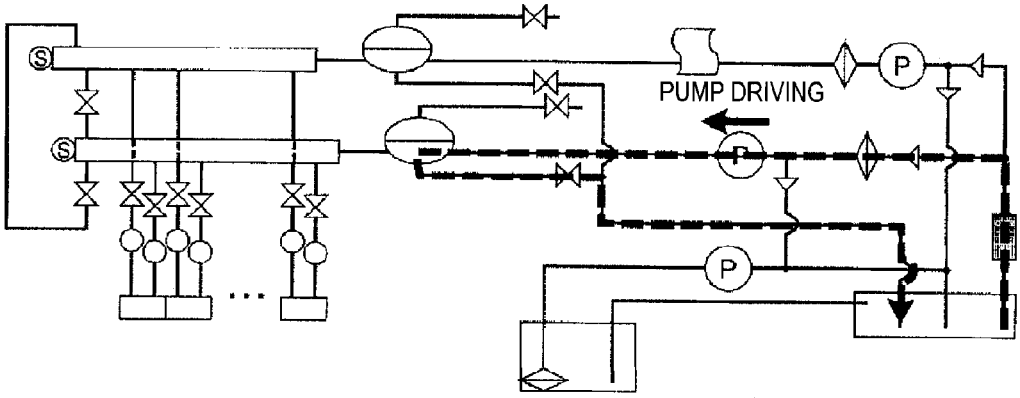

The recovery main pipe 74 serves as a main body and the recovery drain valve 92 installed in the drain pipe 90 is opened to control the flow rate by driving the recovery pump 80 (see FIG. 6C).

Meanwhile, FIG. 6C is the same as the piping diagram shown in FIG. 1, but reference numerals are omitted and the circulation path is also expressed by the thick dashed line.

FIG. 7 is a functional block diagram for executing the ink circulation system program in the ink supply controlling apparatus 110. Meanwhile, in the functional block diagram, the functions are shown through blocking and do not limit a hardware configuration. For example, in the present embodiment, the functions are executed primarily by software programs using the microcomputer 112 of the ink supply controlling apparatus 110.

As shown in FIG. 7, a circulation command is inputted into a circulation mode judging unit 150 of the ink supply controlling apparatus 110.

The circulation mode judging unit 150 analyzes a type of the circulation command. The circulation mode judging unit 150 outputs a start command signal to a valve opening/closing pattern setting unit 152 for first circulation mode when circulation control by pressure control, that is, a circulation mode in stand-by (printing stand-by) in a printable state after power is inputted is commanded.

The circulation mode judging unit 150 outputs a start command signal to valve opening/closing pattern setting units 154, 156 and 158 for second circulation mode, when circulation control by flow-rate control, that is, a case corresponding to any one of execution commands by a regular user which is in stand-by when power is ON after a predetermined time elapsed from the power-OFF.

Herein, a valve opening/closing pattern for second circulation mode includes three types (first to third circulation paths) and the circulation mode judging unit 150 outputs the start signal to the valve opening/closing pattern setting units 154, 156, and 158 for second circulation mode and outputs a time-series switching signal to an execution commanding unit 160 so as to execute valve opening/closing settings by the valve opening/closing pattern setting units 154, 156, and 158 for second circulation mode according to a predetermined sequence.

First, the execution commanding unit 160 starts the valve opening/closing pattern setting unit (a first circulation path) 154 for second circulation mode to form the first circulation path.

Subsequently, the execution commanding unit 160 starts the valve opening/closing pattern setting unit (a second circulation path) 156 for second circulation mode to form the first circulation path.

Finally, the execution commanding unit 160 starts the valve opening/closing pattern setting unit (a third circulation path) 158 for second circulation mode to form the third circulation path.

The circulation path is switched by the execution commanding unit 160 based on the circulation command inputted into the circulation mode judging unit 150.

Each of the valve opening/closing pattern setting unit 152 for first circulation mode and the valve opening/closing pattern setting units 154, 156, and 158 for second circulation mode is connected to a valve opening/closing commanding unit 162.

The valve opening/closing commanding unit 162 is connected to each of the head module circulation system controlling unit 126, the pressure adjustment controlling unit 128, and the drain controlling unit 130.

The valve opening/closing commanding unit 162 controls the opening/closing of the supply valve 22, the recovery valve 26, the first bypass valve 36, and the second bypass valve 38 through the head module circulation system controlling unit 126, controls the opening/closing of the supply air valve 66 and the recovery air valve 88 through the pressure adjustment controlling unit 128, and controls the opening/closing of the supply drain valve 70 and the recovery drain valve 92 through the drain controlling unit 130, based on the valve opening/closing command from the valve opening/closing pattern setting unit 152 for first circulation mode and the valve opening/closing pattern setting units 154, 156, and 158 for second circulation mode.

The valve opening/closing commanding unit 162 is connected to a pump driving commanding unit 164 and outputs a driving command to drive the supply pump 54 and/or the recovery pump 80 after commanding the opening/closing of the valve.

The pump driving commanding unit 164 is connected to a flow rate controlling portion 166 and a pressure controlling portion 168 of the pump driving controlling unit 132 to output the execution command to any one of the portion based on the commanded circulation mode.

The flow rate controlling portion 166 and the pressure controlling portion 168 are connected with the supply pump 54 and the recovery pump 80, respectively. A detection pressure value outputting unit 170 is connected to the pressure controlling unit 168. The supply pressure sensor 40 and the recovery pressure sensor 42 are connected to the detection pressure value outputting unit 170, such that detection signals from the supply pressure sensor 40 and the recovery pressure sensor 42 are inputted into the pressure controlling portion 168.

Hereinafter, an operation of the embodiment will be described.

Meanwhile, in the present embodiment, as shown in FIG. 8, a valve opening/closing pattern table 118A in the first circulation mode and the second circulation mode (the first to third circulation paths) is, in advance, stored in the ROM 118.

FIGS. 9, 10, 14, and 15 relate to the present embodiment and are flowcharts illustrating the flow of a process for executing circulation control of a circulation mode based on pressure control and flow rate control in the ink supply controlling apparatus 110.

Figure 9:
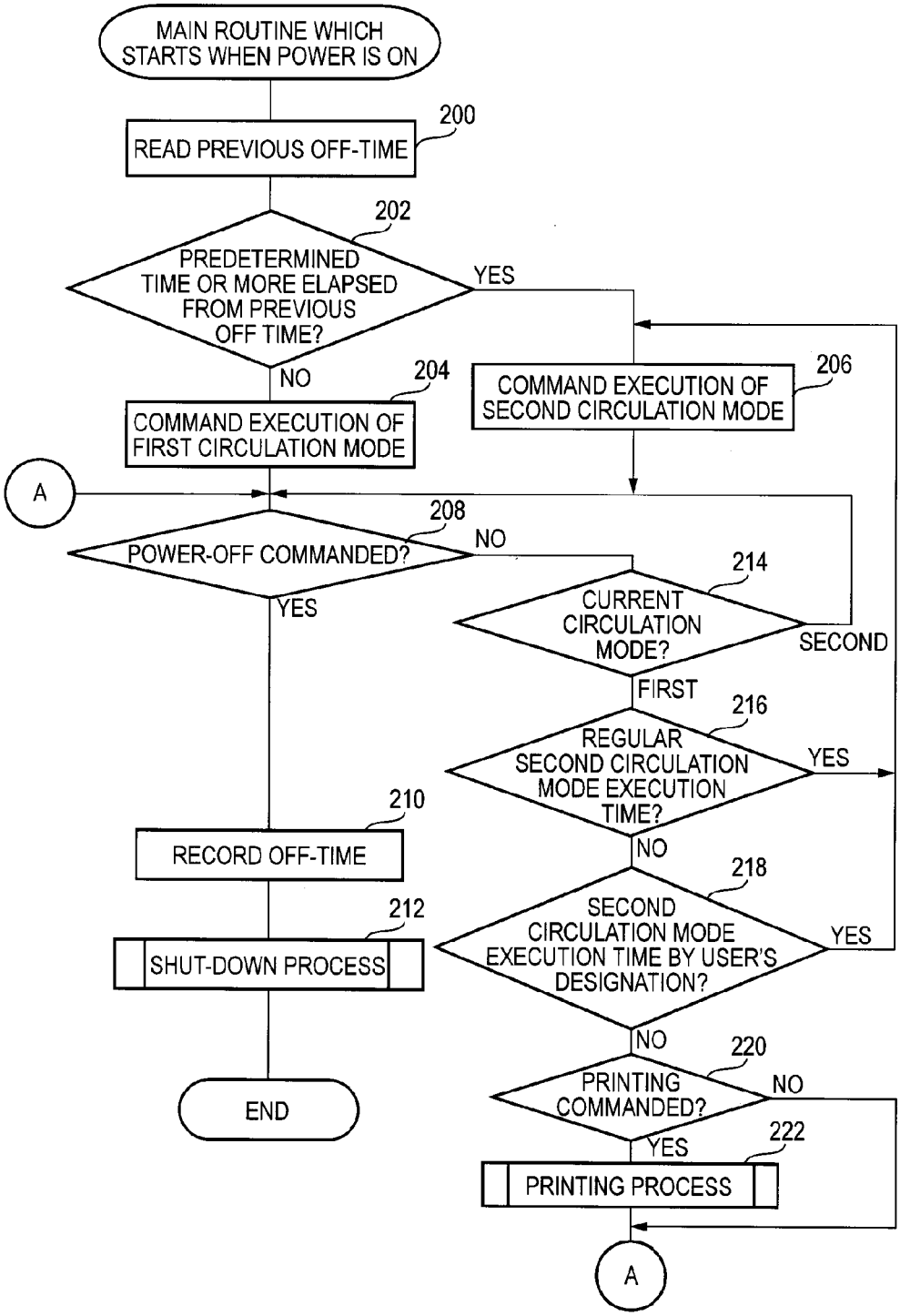

FIG. 9 is a flowchart illustrating a main routine for circulation control which starts when power is ON.

At step S200, a previous OFF-time is read and thereafter, the process proceeds to step S202 to judge whether a predetermined time elapsed from the previous OFF-time. When negatively judged at step S202, it is judged that forced circulation for removing air bubbles is not required and thus, the process proceeds to step S204 to output a first circulation mode execution command and thereafter, the process proceeds to step S208.

When positively judged at step S202, it is estimated that ink is accumulated for a long time, and as a result, the air bubbles may be generated. Thus, the process proceeds to step S206 to command the execution of a second circulation mode which is the forced circulation and thereafter, the process proceeds to step S208.

At step S208, it is judged whether power-off is commanded. When positively judged in step S208, the process proceeds to step S210 to record an off time. Continuously, the process proceeds to step S212 to process a shut-down and thereafter, this routine ends.

When negatively judged at step S208, the process proceeds to step S214. At step S214, it is determined whether a current circulation mode is the first circulation mode or the second circulation mode. That is, in the present embodiment, since a printing (image forming) stand-by state is the first circulation mode, either one of the first circulation mode and the second circulation mode never fails to be executed.

Therefore, at step S214, the current circulation mode is determined and when the current circulation mode is determined to be the second circulation mode, the process returns to step S208.

When the current circulation mode is determined to be the first circulation mode in step S214, the process proceeds to step S216.

At step S216, a regular second circulation mode execution time or not is judged and when positively judged, the process proceeds to step S206 to command the execution of the second circulation mode. When negatively judged in step S216, the process proceeds to step S218.

At step S218, it is judged whether the execution of the second circulation mode is commanded by a user's designation and when positively judged, the process proceeds to step S206 to command the execution of the second circulation mode. When negatively judged at step S218, the process proceeds to step S220.

At step S220, it is judged whether printing is commanded and when negatively judged, the process proceeds to step S208 to repeat the above processes. When positively judged at step S200, the process proceeds to step S222 to execute printing processing and thereafter, the process returns to step S208 to repeat the above processes.

Figure 10:
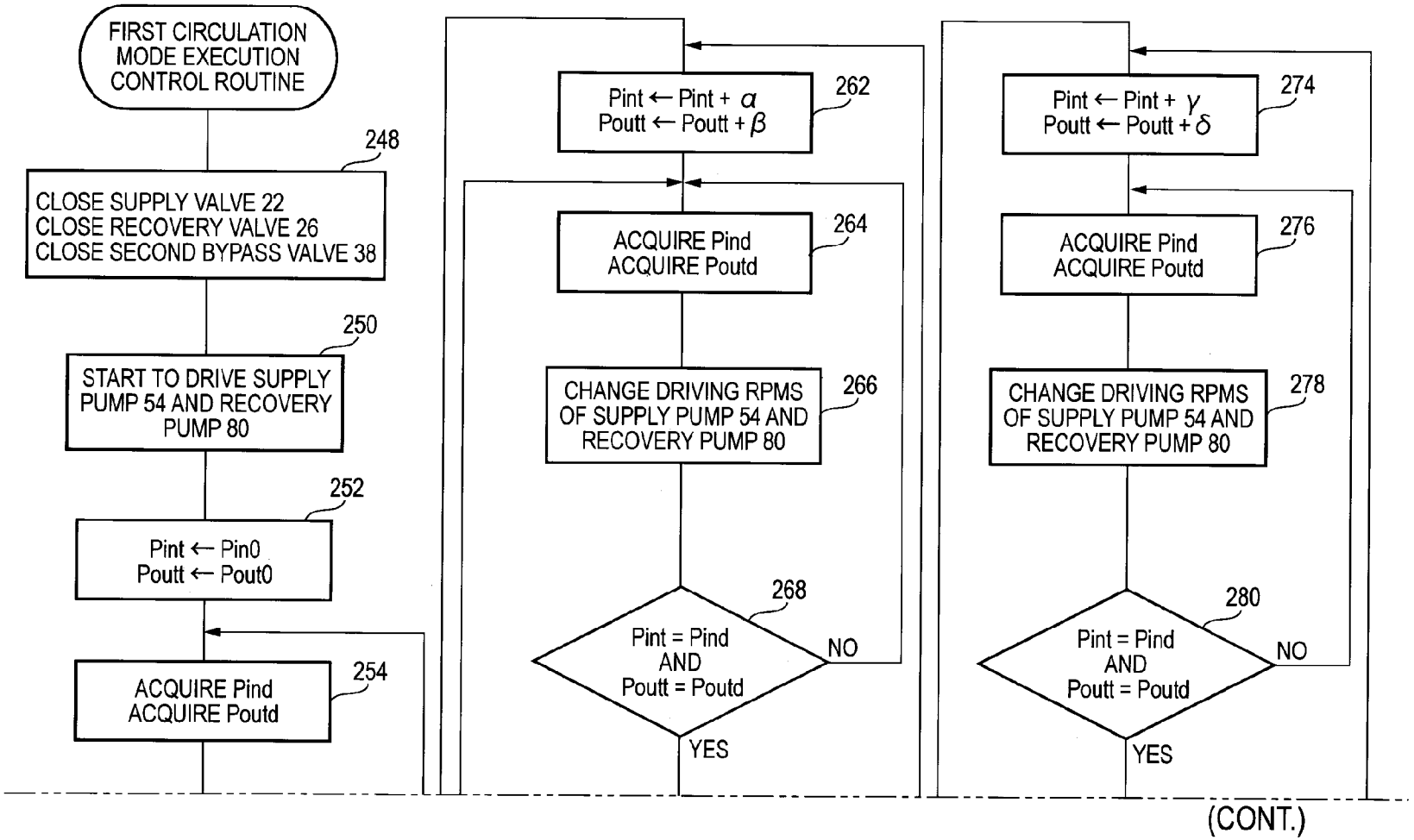
FIG. 10 is a flowchart illustrating a first circulation mode execution control routine of FIG. 9.

FIG. 10 is a flowchart illustrating a first circulation mode execution control routine.

First, at step S248, the supply valve 22, the recovery valve 26, and the second bypass valve 38 are closed to prevent ink from being circulated with respect to the head module 12. While executing the first circulation mode, the first bypass valve 36, the supply air valve 66, the recovery air valve 88, the supply drain valve 70, and the recovery drain valve 92 are closed at all times as shown in a valve opening/closing pattern table of FIG. 8.

Subsequently, the process proceeds to step S250 to start the driving of the supply pump 54 and the recovery pump 80.

Figure 11:
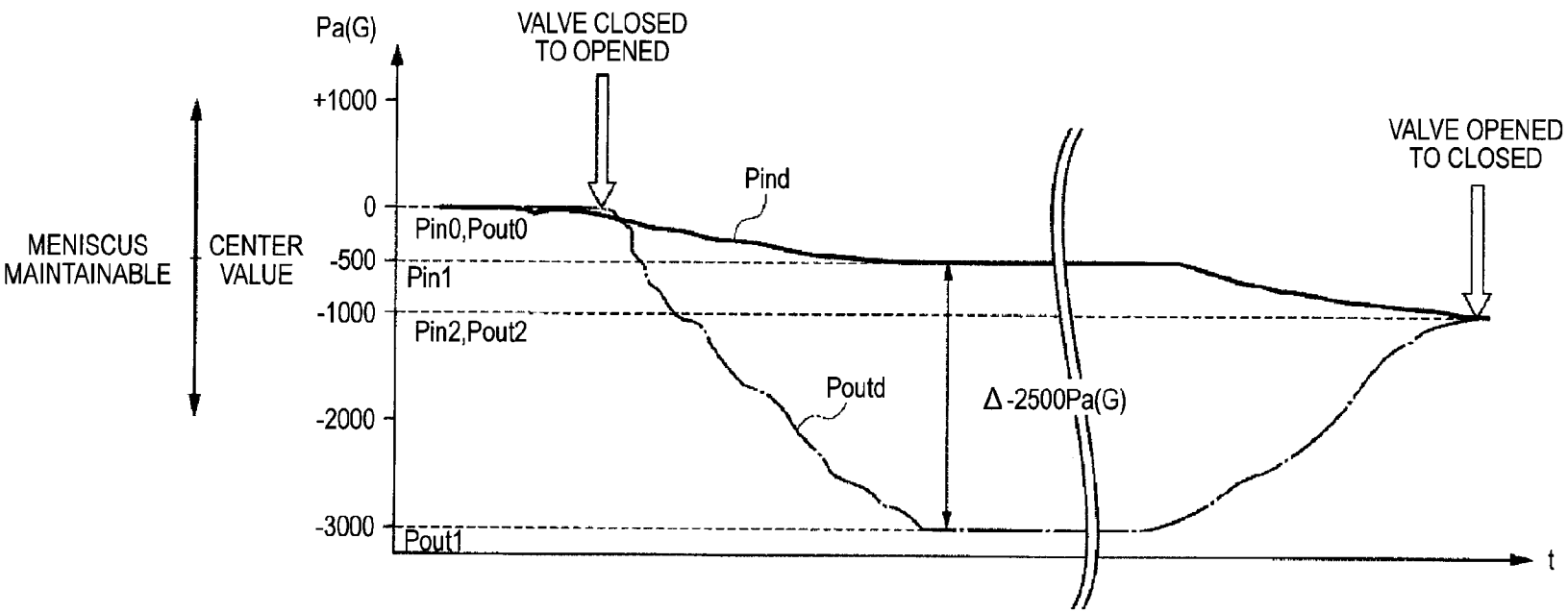
FIG. 11 is an explanatory diagram illustrating changes in supply pressure and recovery pressure in the first ink circulation mode.

Thereafter, the process proceeds to step S252 to set a supply start pressure $P_{in0}$ into a supply target pressure $P_{int}$ and a recovery start pressure $P_{out0}$ into a recovery target pressure $P_{outt}$ (see FIG. 11).

Thereafter, the process proceeds to step S254 to acquire a detection value $P_{ind}$ of the supply pressure sensor 40 and a detection value $P_{outd}$ of the recovery pressure sensor 42.

Thereafter, the process proceeds to step S256 to change the driving rpm of the supply pump 54 so that the supply target pressure $P_{int}$ and the detection value $P_{ind}$ are consistent with each other. The driving rpm of the recovery pump 80 is changed so that the recovery target pressure $P_{outt}$ and the detection value $P_{outd}$ are consistent with each other.

Thereafter, the process proceeds to step S258 to judge whether the supply target pressure $P_{int}$ and the detection value $P_{ind}$ are consistent with each other and the recovery target pressure $P_{outt}$ and the detection value $P_{outd}$ are consistent with each other. When negatively judged, the process returns to step S254. Meanwhile, the 'consistency' represents the state where the difference between the objects of comparison is equal to or less than a predetermined threshold value.

Meanwhile, when positively judged, the process proceeds to step S260 to open the supply valve 22, the recovery valve 26, and the second bypass valve 38. As a result, the circulation path in the first circulation mode shown in FIG. 5 is formed. The supply valve 22 and the recovery valve 26 are provided in plural numbers and the plurality of valves may be opened sequentially at appropriate time intervals rather than the case where the plurality of valves are opened all at once.

As shown in FIG. 11, since the supply start pressure $P_{in0}$ and the recovery start pressure $P_{out0}$ are set to 0 Pa(G), respectively, the differential pressure between the pressure at the supply side and the pressure at the recovery side is substantially zero (0). Therefore, even though the supply valve 22 and the recovery valve 26 are opened, ink does not flow in the head module 12. Meanwhile, accurately, values at which the differential pressure ΔP on a nozzle surface is substantially zero (0) are given to the supply start pressure $P_{in0}$ and the recovery start pressure $P_{out0}$ by considering head differences $h_{in}$ and $h_{out}$ from the nozzle surface.

Thereafter, the process proceeds to step S262 to change the supply target pressure $P_{int}$ by adding a predetermined value α (for example, −50 Pa(G)) to the supply target pressure $P_{int}$. The recovery target pressure $P_{outt}$ is changed by adding a predetermined value β (for example, −100 Pa(G)) to the recovery target value $P_{outt}$.

Thereafter, the process proceeds to step S264 to acquire the detection value $P_{ind}$ of the supply pressure sensor 40 and the detection value $P_{outd}$ of the recovery pressure sensor 42.

Thereafter, the process proceeds to step S266 to change the driving rpm of the supply pump 54 so that the supply target pressure $P_{int}$ and the detection value $P_{ind}$ are consistent with each other. The driving rpm of the recovery pump 80 is changed so that the recovery target pressure $P_{outt}$ and the detection value $P_{outd}$ are consistent with each other.

Thereafter, the process proceeds to step S268 to judge whether the supply target pressure $P_{int}$ and the detection value $P_{ind}$ are consistent with each other and the recovery target pressure $P_{outt}$ and the detection value $P_{outd}$ are consistent with each other. When negatively judged, the process proceeds to step S264 to repeat the above processes.

Meanwhile, when positively judged, the process proceeds to step S270 to judge whether the supply target pressure $P_{int}$ is a predetermined supply circulation pressure $P_{in1}$ and the recovery target pressure $P_{outt}$ is a predetermined recovery circulation pressure $P_{out1}$. When negatively judged, the process returns to step S262 to repeat the above processes. Meanwhile, the values α and β are added when step S262 is repeated until the supply target pressure $P_{int}$ and the recovery target pressure $P_{outt}$ reach the supply circulation pressure $P_{in1}$ and the recovery circulation pressure $P_{out1}$, respectively.

As shown in FIG. 11, since the supply circulation pressure $P_{in1}$ and the recovery circulation pressure $P_{out1}$ are set to −500 Pa(G) and −3,000 Pa(G), respectively, the differential pressure is slowly increased at the supply side and the recovery side, and finally, the differential pressure during circulation of −2500 Pa(G) is generated. That is, the ink starts flowing in the head module 12 and the ink circulates as expressed by the thick dashed line of FIG. 5.

When positively judged in step S270, the process proceeds to step S272 to judge whether the execution of the second circulation mode is commanded or power-OFF is commanded. When negatively judged, the process returns to step S264 to repeat the above processes. That is, the first circulation mode is at all times executed as a stand-by mode for printing (image forming), such that pressure variation based on a discharge amount from the nozzle 11 is reflected to feed-back control of the driving rpm of the pump even during printing processing.

When positively judged in step S272, the process proceeds to step S274 to change the supply target pressure $P_{int}$ by adding a predetermined value γ (for example, −50 Pa(G)) to the supply target pressure $P_{int}$. The recovery target pressure $P_{outt}$ is changed by adding a predetermined value δ (for example, +100 Pa(G)) to the recovery target pressure $P_{outt}$.

Thereafter, the process proceeds to step S276 to acquire the detection value $P_{ind}$ of the supply pressure sensor 40 and the detection value $P_{outd}$ of the recovery pressure sensor 42.

Thereafter, the process proceeds to step S278 to change the driving rpm of the supply pump 54 so that the supply target pressure $P_{int}$ and the detection value $P_{ind}$ are consistent with each other. The driving rpm of the recovery pump 80 is changed so that the recovery target pressure $P_{outt}$ and the detection value $P_{outd}$ are consistent with each other.

Thereafter, the process proceeds to step S280 to judge whether the supply target pressure $P_{int}$ and the detection value $P_{ind}$ are consistent with each other and the recovery target pressure $P_{outt}$ and the detection value $P_{outd}$ are consistent with each other. When negatively judged, the process returns to step S276 to repeat the above processes.

When positively judged in step S280, the process proceeds to step S282 to judge whether the supply target pressure $P_{int}$ is a predetermined supply ending pressure $P_{in2}$ and the recovery target pressure $P_{outt}$ is a predetermined recovery ending pressure $P_{out2}$. When negatively judged, the process returns to step S274 to repeat the above processes. The values γ and 6 are added when step S274 is repeated until the supply target pressure $P_{int}$ and the recovery target pressure $P_{outt}$ reach the supply ending pressure $P_{in2}$ and the recovery ending pressure $P_{out2}$, respectively.

When positively judged at step S282, the process proceeds to step S284 to close the supply valve 22, the recovery valve 26, and the second bypass valve 38. Meanwhile, the supply valve 22 and the recovery valve 26 are provided in plural numbers and the plurality of valves may be closed sequentially at appropriate time intervals rather than the case where the plurality of valves are closed all at once.

As shown in FIG. 11, the supply ending pressure $P_{in2}$ and the recovery ending pressure $P_{out2}$ are set to −1,000 Pa(G), respectively, and the differential pressure between the pressure at the supply side and the pressure at the recovery side is slowly decreased, and as a result, the differential pressure becomes substantially zero (0) and thereafter, the supply valve 22, the recovery valve 26, and the second bypass valve 38 are closed. That is, the ink stops flowing with respect to the head module 12, and thereafter, each valve is closed.

Subsequently, the process proceeds to step S286 to first stop driving the supply pump 54 and the recovery pump 80. Thereafter, this routine ends. Alternatively, the supply pump 54 and the recovery pump 80 may be continuously driven as it is.

Figure 12A:
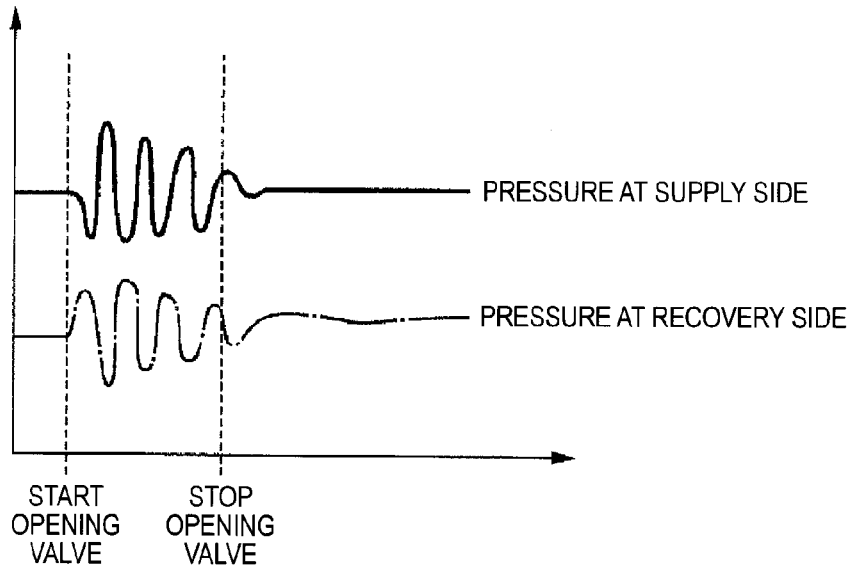

As shown in FIG. 12A, when the ink starts the circulating with respect to the nozzle 11, the supply valve 22 and the recovery valve 26 are opened while the differential pressure is generated between the pressure at the supply side and the pressure at the recovery side during circulation, such that the pressure at the supply side and the pressure at the recovery side are largely varied. As a result, the back pressure $P_{nzl}$ applied to the nozzle 11 deviates from a meniscus-maintainable pressure range (−2,000 Pa(G) to +1,000 Pa(G)), such that ink may leak from the nozzle 11 or air bubbles may penetrate from the nozzle 11.

Figure 12B:
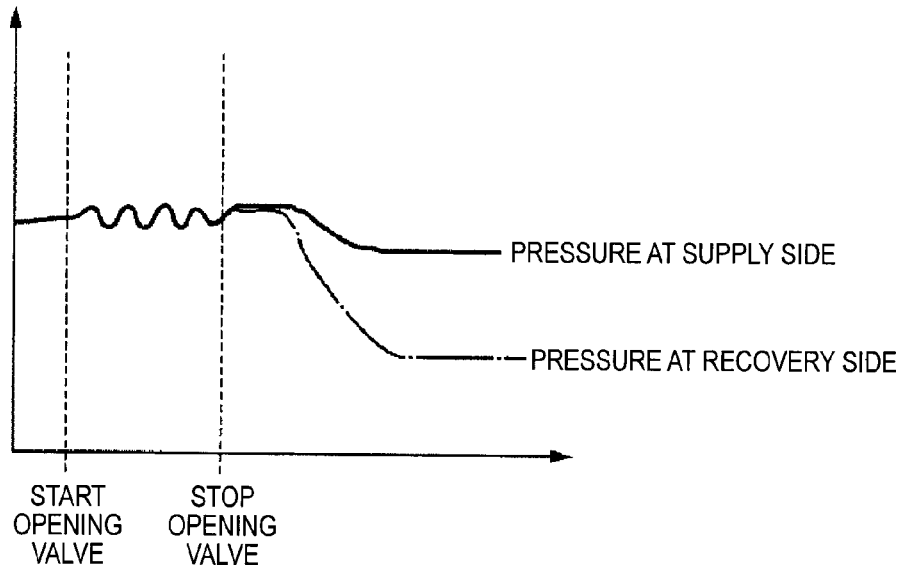

As shown in FIG. 12B, when the ink starts circulating with respect to the nozzle 11, the differential pressure between the pressure at the supply side and the pressure at the recovery side is made to be substantially zero (0) while the supply valve 22 and the recovery valve 26 are closed, and thereafter, when the supply valve 22 and the recovery valve 26 are opened, the pressure at the supply side and the pressure at the recovery side are slightly varied. As a result, the back pressure $P_{nzl}$ applied to the nozzle 11 does not deviate from the meniscus-maintainable pressure range, such that the ink leakage from the nozzle 11 or the penetration of the air bubbles from the nozzle 11 is suppressed.

Figure 13A:
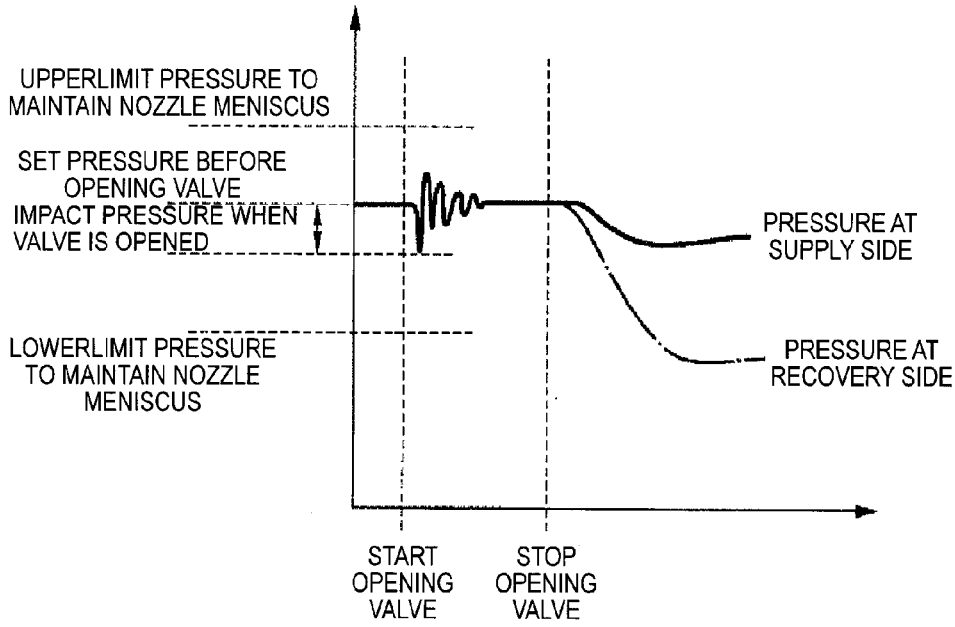

As shown in FIG. 13A, when the ink starts circulating with respect to the nozzle 11 and the supply valve 22 and the recovery valve 26 are opened, large pressure variation (impact pressure) is generated at a negative pressure side. As a result, the supply start pressure $P_{in0}$ and the recovery start pressure $P_{out0}$ are set to zero (0) Pa(G) which is a positive pressure side with respect to a center value (−500 Pa(G)) of the meniscus maintainable pressure range.

Figure 13B:
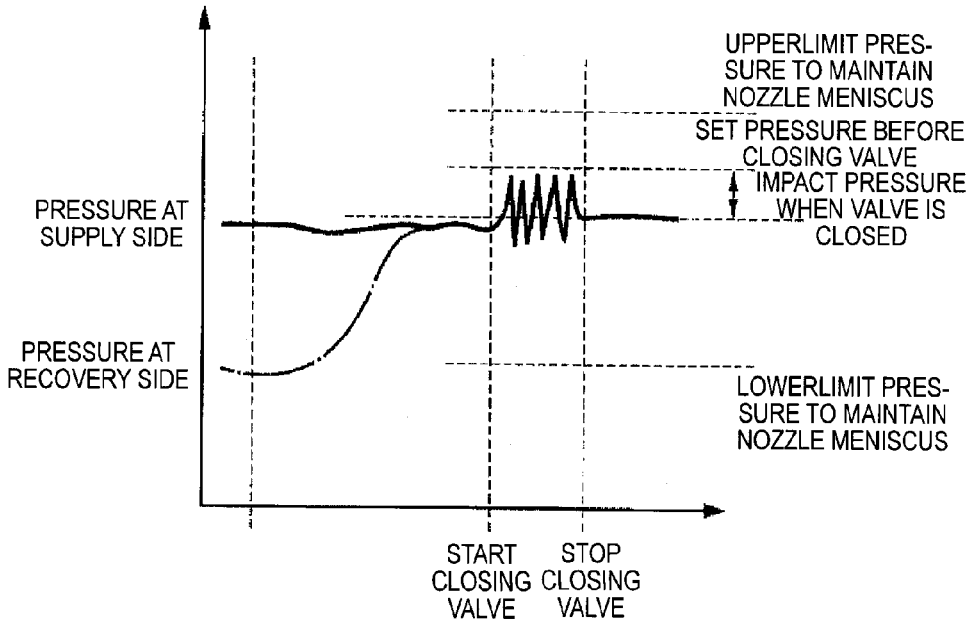

As shown in FIG. 13B, when the ink stops circulating with respect to the nozzle 11 and the supply valve 22 and the recovery valve 26 are closed, the large pressure variation (impact pressure) is generated at the positive pressure side. As a result, the supply ending pressure $P_{in2}$ and the recovery ending pressure $P_{out2}$ are set to −1,000 Pa(G) which is the negative pressure side with respect to the center value (−500 Pa(G)) of the meniscus maintainable pressure range.

Meanwhile, FIGS. 12B and 13B are the same graphs illustrating the pressure changes at the supply side and the recovery side, but represent changes having features for describing respective maps.

Figure 14:
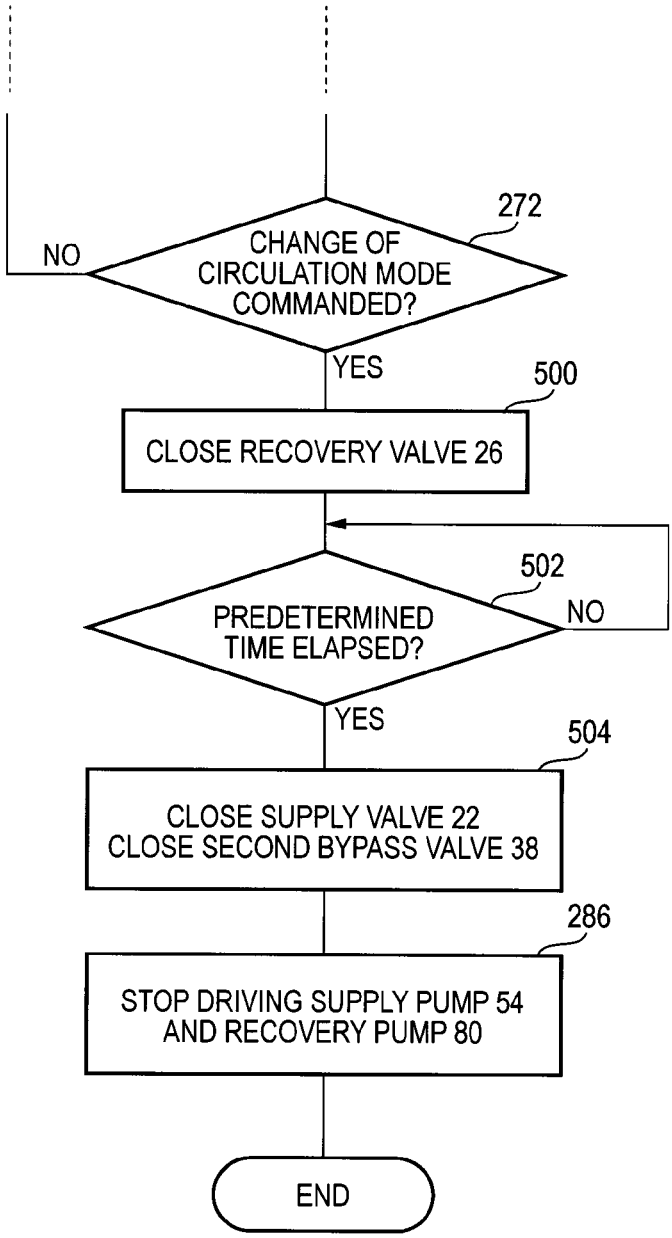
FIG. 14 is a diagram illustrating a control routine of another aspect substituted for steps 274 to 284 of the flowchart shown in FIG. 10.

FIG. 14 is a diagram illustrating a control routine of another aspect substituted for steps S274 to S284 of the flowchart shown in FIG. 10. In other words, when positively judged in step S272, the process proceeds to step S500 to close the recovery valve 26. Thereafter, the elapsing of a predetermined time is waited at step S502, and thereafter, the process proceeds to step S504 to close the supply valve 22 and the second bypass valve 38. Subsequently, the process proceeds to step S286 to first stop driving the supply pump 54 and the recovery pump 80. Thereafter, this routine ends. Meanwhile, at step S500, the plurality of recovery valves 26 may be closed sequentially at appropriate intervals rather than the case where the plurality of recovery valves 26 are closed all at once.

As described above, at steps S500 to S504, when the circulation of the ink ends, the recovery valve 26 is first closed between the supply valve 22 and the recovery valve 26, such that the back pressure $P_{nzl}$ applied to the nozzle 11 becomes a control pressure (−500 Pa(G)) at the supply side. Since the control pressure (−500 Pa(G)) at the supply side is the meniscus maintainable pressure range, the circulation of the ink may end without the ink leakage from the nozzle 11 or the penetration of the air bubbles from the nozzle 11.

Since the emergency power supply 200 is connected to the supply valve 22 and the recovery valve 26, the supply valve 22 and the recovery valve 26 may be closed even in an abnormal state such as a power outage, such that the circulation of the ink may end without the ink leakage from the nozzle 11 or the penetration of the air bubbles from the nozzle 11.

Figure 15:
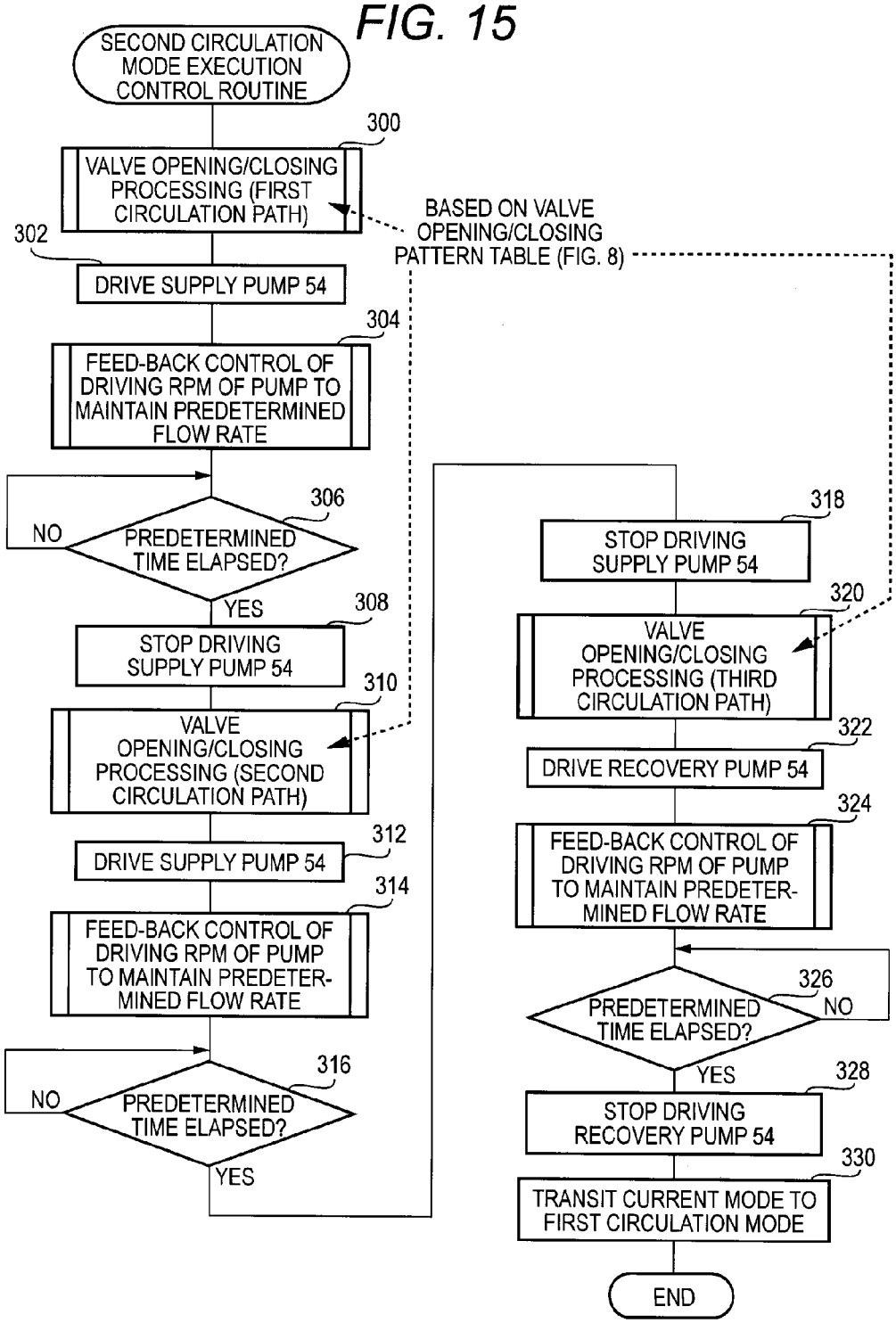
FIG. 15 is a flowchart illustrating a second circulation mode execution control routine.

FIG. 15 is a flowchart illustrating a second circulation mode execution control routine.

At step S300, a valve opening/closing processing is executed based on the valve opening/closing pattern table shown in FIG. 8. As a result, the first circulation path in the second circulation mode shown in FIG. 6A is formed.

At step S302, the supply pump 54 is driven to start circulating the ink. By the driving of the supply pump 54, the ink circulates as expressed by the thick dashed line of FIG. 6A.

At step S304, the feed-back control of the driving rpm of the pump for maintaining a predetermined flow rate is executed and the process proceeds to step S306.

At step S306, it is judged whether a predetermined time elapsed and when positively judged, the process proceeds to step S308 to stop driving the supply pump 54 and the process proceeds to step S310.

At step S310, the valve opening/closing processing is executed based on the valve opening/closing pattern table shown in FIG. 8. As a result, the second circulation path in the second circulation mode shown in FIG. 6B is formed.

At step S312, the supply pump 54 is driven to start circulating the ink. By the driving of the supply pump 54, the ink circulates as expressed by the thick dashed line of FIG. 6B.

At step S314, the feed-back control of the driving rpm of the pump for maintaining a predetermined flow rate is executed and the process proceeds to step S316.

At step S316, it is judged whether a predetermined time elapsed and when positively judged, the process proceeds to step S318 to stop driving the supply pump 54 and the process proceeds to step S320.

At step S320, the valve opening/closing processing is executed based on the valve opening/closing pattern table shown in FIG. 8. As a result, the third circulation path in the second circulation mode shown in FIG. 6C is formed.

At step S322, the recovery pump 80 is driven to start circulating the ink. By the driving of the recovery pump 80, the ink circulates as expressed by the thick dashed line of FIG. 6C.

At step S324, the feed-back control of the driving rpm of the pump for maintaining a predetermined flow rate is executed and the process proceeds to step S326.

At step S326, it is judged whether a predetermined time elapsed and when positively judged, the process proceeds to step S328 to stop driving the recovery pump 80 and the process proceeds to step S330.

At step S330, the current mode is transited to the first circulation mode and this routine ends.

As described above, the inkjet head 10 includes the head module 12 having the nozzle 11 that discharges the ink, the supply path (the supply main pipe 48, the supply pipe 28, the supply manifold 14, and the supply branch pipe 16) that supplies the ink to the head module 12, the recovery path (the recovery main pipe 74, the recovery pipe 30, the recovery manifold 18, and the recovery branch pipe 20) that recovers the ink from the head module 12, the supply pump 54 that adjusts the ink pressure of the supply path, the recovery pump 80 that adjusts the ink pressure of the recovery path, the supply valve 22 that opens/closes the supply path, and the recovery valve 26 that opens/recovers the recovery path. And the inkjet head 10 controls the driving of the supply pump 54, the recovery pump 80, the supply valve 22, and the recovery valve 26 to make the differential pressure between the pressure at the supply side and the pressure at the recovery side to be lower than the different pressure during circulation (substantially zero) while the supply valve 22 and the recovery valve 26 are closed when the ink is circulated by causing the differential pressure (−2500 Pa(G)) between the pressure at the supply side and the pressure at the recovery side during circulation with respect to the nozzle 11 while the ink maintains the meniscus in the nozzle 11. And, thereafter, the supply valve 22 and the recovery valve 26 are opened. Thereafter, the differential pressure is slowly changed to a circulation time difference pressure.

Therefore, when the ink starts circulating with respect to the nozzle 11, even though the supply valve 22 and the recovery valve 26 are opened, the ink does not flow in/out to/from the head module 12, and as a result, fluctuation of the back pressure $P_{nzl}$ applied to the nozzle 11 is suppressed, such that the ink leakage from the nozzle 11 or the penetration of the air bubbles from the nozzle 11 is suppressed.

Each of the pressure at the supply side and the pressure at the recovery side is set to the pressure (zero Pa(G)) in the meniscus maintainable pressure range while the supply valve 22 and the recovery valve 26 are closed.

Therefore, when the ink starts circulating with respect to the nozzle 11, even though the supply valve 22 and the recovery valve 26 are opened, the ink maintains the meniscus in the nozzle 11, such that the ink leakage from the nozzle 11 or the penetration of the air bubbles into the nozzle 11 is suppressed.

Each of the pressure at the supply side and the pressure at the recovery side is set to the pressure (zero Pa(G)) at the positive pressure side with respect to the center value (−500 Pa(G)) of the meniscus maintainable pressure range while the supply valve 22 and the recovery valve 26 are closed.

Therefore, when the ink starts circulating with respect to the nozzle 11, even though large pressure fluctuation is applied to the nozzle 11 at the negative pressure side caused when the supply valve 22 and the recovery valve 26 are opened, it is certain that the ink maintains the meniscus in the nozzle 11, such that the ink leakage from the nozzle 11 or the penetration of the air bubbles into the nozzle 11 is further suppressed.

The second bypass path 34 that is connected to the supply path and the recovery path to bypass the head module 12 and the second bypass valve that is installed on the second bypass path 34 to open/close the second bypass path 34 are provided, and, at the same time, the second bypass path 34 is opened in synchronization with the opening of the supply valve 22 and the recovery valve 26.

Therefore, when the ink starts circulating with respect to the nozzle 11, the ink passes through the second bypass path 34, such that it is difficult for the ink to flow in/out to/from the head module 12, and as a result, the fluctuation of the back pressure $P_{nzl}$ applied to the nozzle 11 is further suppressed, thereby suppressing the ink leakage from the nozzle 11 or the penetration of the air bubbles from the nozzle 11.

When the ink stops circulating with respect to the nozzle 11, the differential pressure between the pressure at the supply side and the pressure at the recovery side is slowly changed to a differential pressure (substantially zero) lower than the differential pressure (−2500 Pa(G)) during circulation while the supply valve 22 and the recovery valve 26 are opened and thereafter, the supply valve 22 and the recovery valve 26 are closed.

Accordingly, when the ink stops circulating with respect to the nozzle 11, the fluctuation of the back pressure $P_{nzl}$ applied to the nozzle 11 is suppressed, and as a result, the ink leakage from the nozzle 11 or the penetration of the air bubbles from the nozzle 11 is suppressed.

When the ink stops circulating with respect to the nozzle 11, each of the pressure at the supply side and the pressure at the recovery side is set to the pressure (−1,000 Pa(G)) in the meniscus maintainable pressure range while the supply valve 22 and the recovery valve 26 are opened.

Accordingly, when the ink stops circulating with respect to the nozzle 11, the ink maintains the meniscus in the nozzle 11, and as a result, the ink leakage from the nozzle 11 or the penetration of the air bubbles into the nozzle 11 is suppressed.

When the ink stops circulating with respect to the nozzle 11, each of the pressure at the supply side and the pressure at the recovery side is set to the pressure (−1,000 Pa(G)) at the negative pressure side with respect to the center value (−500 Pa(G)) of the meniscus maintainable pressure range while the supply valve 22 and the recovery valve 26 are opened.

Therefore, when the ink stops circulating with respect to the nozzle 11, even though large pressure fluctuation is applied to the nozzle 11 at the positive pressure side caused when the supply valve 22 and the recovery valve 26 are closed, it is certain that the ink maintains the meniscus in the nozzle 11, such that the ink leakage from the nozzle 11 or the penetration of the air bubbles into the nozzle 11 is further suppressed.

When the ink circulates with respect to the nozzle 11, the recovery valve 26 is first closed by controlling the pressure at the supply side to the pressure (−500 Pa(G)) of the meniscus maintainable pressure range and controlling the pressure at the recovery side to a pressure (−3,000 Pa(G)) at which the ink cannot maintain the meniscus.

Accordingly, when the ink circulates with respect to the nozzle 11, the back pressure $P_{nzl}$ applied to the nozzle 11 becomes the pressure at the supply side, which is the meniscus maintainable pressure range, and as a result, the ink leakage from the nozzle 11 or the penetration of the air bubbles from the nozzle 11 is suppressed.

The emergency power supply 200 that supplies power for operating the supply valve 22 and the recovery valve 26 is installed.

Therefore, even in the abnormal state such as the power outage, since the supply valve 22 and the recovery valve 26 can be closed, the ink leakage from the nozzle 11 or the penetration of the air bubbles from the nozzle 11 is suppressed.

The ink which circulates with respect to the nozzle 11 is discharged from the nozzle 11.

Therefore, fresh ink is discharged from the nozzle 11 at all times.

Figure 16:
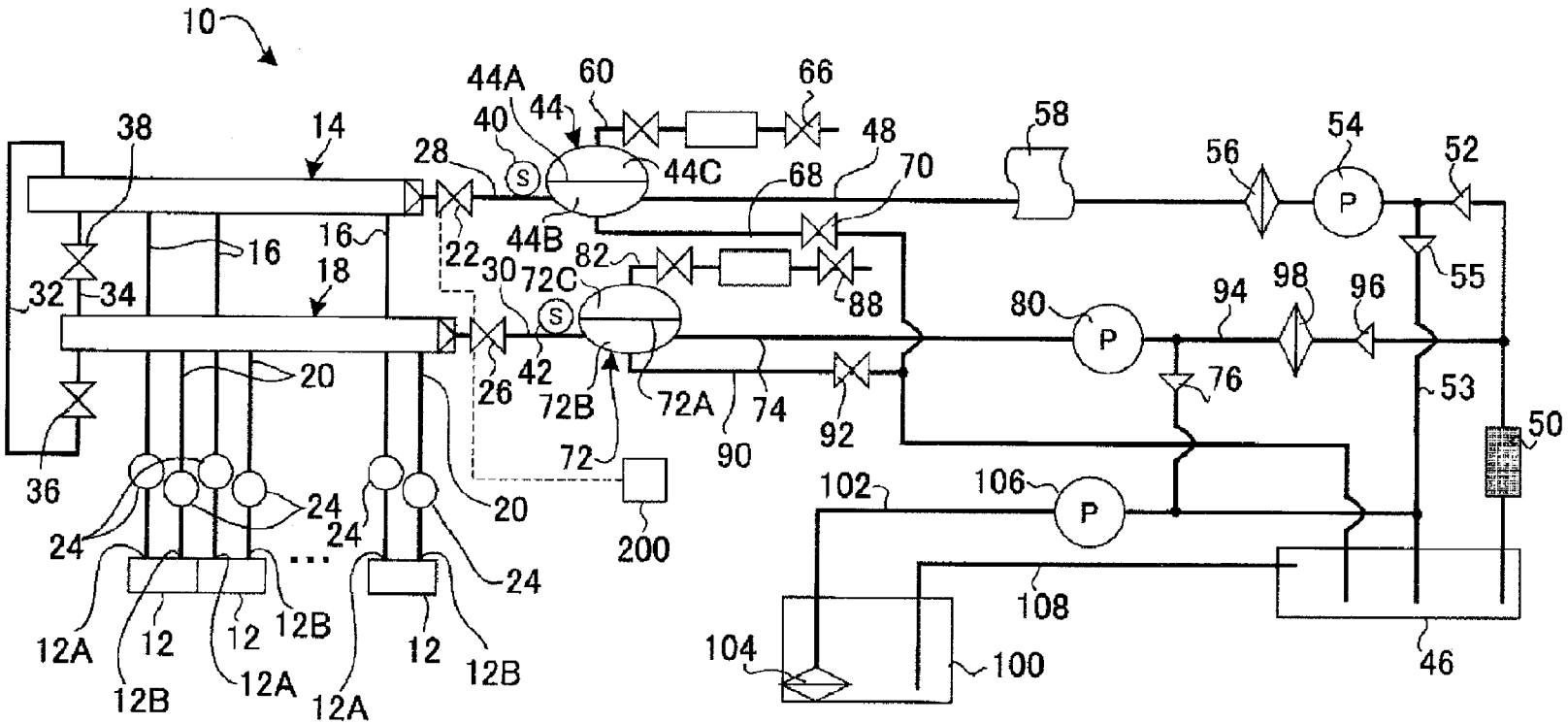
FIG. 16 is a diagram illustrating another aspect of the piping diagram of the inkjet head shown in FIG. 1.

Meanwhile, in the above description, although the supply valves 22 are installed in the supply branch pipes 16 installed for each head module 12, respectively, one supply valve 22 may be installed in the supply pipe 28 as shown in FIG. 16. Similarly, one recovery valve 26 may be installed in the recovery pipe 30. In this case, the supply pressure sensor 40 is installed at the upstream side of the supply valve 22 of the supply pipe 28 and the recovery pressure sensor 42 is installed at the downstream side of the recovery valve 26 of the recovery pipe 30 to detect the pressure at the supply side and the pressure at the recovery side. As the number of valves decreases, the emergency power supply 200 can be minimized.

In the above description, although the ink starts or stops circulating with respect to the head module 12 by installing both the supply valve 22 and the recovery valve 26, the circulation can even start or end in only any one of the supply valve 22 and the recovery valve 26, and as a result, only any one of the supply valve 22 and the recovery valve 26 may be installed.

In the above description, although the pressure $P_{in1}$ during circulation at the supply side is set to −500 Pa(G), the pressure $P_{out1}$ during circulation at the recovery side is set to −3,000 Pa(G), and the differential pressure during circulation is set to −2,500 Pa(G), the pressure $P_{out1}$ during circulation at the recovery side may be set to −1,000 Pa(G) which is the pressure of the meniscus maintainable pressure range, the pressure $P_{in1}$ during circulation at the supply side may be set to +1500 Pa(G), which is the pressure other than the meniscus maintainable pressure range, and the differential pressure during circulation may be set to −2500 Pa(G). In this case, at step S500 of the flowchart shown in FIG. 14, since the back pressure $P_{nz1}$ applied to the nozzle 11 becomes the pressure at the recovery side which is the meniscus maintainable pressure by first closing the supply valve 22, the circulation of the ink can end without the ink leakage from the nozzle 11 or the penetration of the air bubbles from the nozzle 11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid circulating apparatus comprising:

a liquid discharging unit that has a nozzle which discharges a liquid;

a supply path that supplies the liquid to the liquid discharging unit;

a recovery path that recovers the liquid from the liquid discharging unit;

a first pressure adjusting unit that adjusts a pressure of the liquid in the supply path;

a second pressure adjusting unit that adjusts a pressure of the liquid in the recovery path;

an opening/closing valve that is provided at least one of the supply path and the recovery path to open/close the path; and a circulation controlling unit that controls the first pressure adjusting unit, the second pressure adjusting unit and the opening/closing valve to circulate the liquid by causing a differential pressure between the liquid at a supply side and the liquid at a recovery side with respect to the nozzle while the liquid maintains a meniscus in the nozzle, wherein, the circulation controlling unit (i) makes a differential pressure between the liquid of the supply path and the liquid of the recovery path to be lower than the differential pressure in middle of the circulation while the opening/closing valve is closed when the liquid starts circulating with respect to the nozzle, (ii) opens the opening/closing valve, and (iii) changes the differential pressure to the differential pressure in middle of the circulation.

2. The liquid circulating apparatus of claim 1, wherein the circulation controlling unit controls the pressure of the liquid of the supply path and the pressure of the liquid of the recovery path to be a pressure of a pressure range in which the liquid is capable of maintaining the meniscus in the nozzle while the opening/closing valve is closed when the liquid starts circulating with respect to the nozzle.

3. The liquid circulating apparatus of claim 2, wherein the opening/closing valve causes a pressure fluctuation with respect to the nozzle when the opening/closing valve is opened, and the circulation controlling unit controls the pressure of the liquid of the supply path and the pressure of the liquid of the recovery path to be a pressure so as to offset the pressure fluctuation of the opened valve with respect to a center value of the pressure range in which the liquid is capable of maintaining the meniscus in the nozzle while the opening/closing valve is closed when the liquid starts circulating with respect to the nozzle.

4. The liquid circulating apparatus of claim 1, further comprising:

a bypass path that is connected to the supply path and the recovery path to bypass the liquid discharging unit; and a bypass path opening/closing valve that is provided on the bypass path to open/close the bypass path, wherein the circulation controlling unit opens the bypass path opening/closing valve in synchronization with the opening of the opening/closing valve when the liquid starts circulating with respect to the nozzle.

5. The liquid circulating apparatus of claim 1, wherein the circulation controlling unit changes the differential pressure between the liquid of the supply path and the liquid of the recovery path to be a differential pressure lower than the differential pressure in middle of the circulation while the opening/closing valve is opened, and thereafter closes the opening/closing valve when the liquid stops circulating with respect to the nozzle.

6. The liquid circulating apparatus of claim 5, wherein the circulation controlling unit controls the pressure of the liquid of the supply path and the pressure of the liquid of the recovery path to be a pressure of a pressure range in which the liquid is capable of maintaining the meniscus in the nozzle while the opening/closing valve is opened when the liquid stops circulating with respect to the nozzle.

7. The liquid circulating apparatus of claim 6, wherein the opening/closing valve causes a pressure fluctuation with respect to the nozzle when the opening/closing valve is closed, and the circulation controlling unit controls the pressure of the liquid of the supply path and the pressure of the liquid of the recovery path to be a pressure so as to offset the pressure fluctuation of the opened valve with respect to a center value of the pressure range in which the liquid is capable of maintaining the meniscus in the nozzle while the opening/closing valve is opened when the liquid stops circulating with respect to the nozzle.

8. The liquid circulating apparatus of claim 1, wherein the opening/closing valve is provided in each of the supply path and the recovery path, and the circulation controlling unit controls the pressure of the liquid of at least one of the supply path and the recovery path to be a pressure range in which the liquid is capable of maintaining the meniscus in the nozzle when the liquid circulates with respect to the nozzle, and the circulation controlling unit closes the opening/closing valve provided at the other side of the supply path and the recovery path when the liquid stops circulating with respect to nozzle.

9. The liquid circulating apparatus of claim 8, further comprising:

an emergency power supply that supplies power for operating the opening/closing valve.

10. A non-transitory computer-readable medium storing a program that causes a computer to execute as the circulation controlling unit of the liquid circulating apparatus of claim 1.

11. A liquid discharging apparatus that discharges the liquid circulated with respect to the nozzle from the nozzle by the liquid circulating apparatus of claim 1.

* * * * *